US011091896B2

(12) United States Patent
Campbell

(10) Patent No.: US 11,091,896 B2
(45) Date of Patent: Aug. 17, 2021

(54) CABLE ARMORING SYSTEM

(71) Applicant: Bright Technologies, LLC, Havana, FL (US)

(72) Inventor: Richard V. Campbell, Havana, FL (US)

( * ) Notice: Subject to any disclaimer, the term of this patent is extended or adjusted under 35 U.S.C. 154(b) by 239 days.

(21) Appl. No.: 16/298,863

(22) Filed: Mar. 11, 2019

(65) Prior Publication Data

US 2019/0368159 A1 Dec. 5, 2019

Related U.S. Application Data

(63) Continuation-in-part of application No. 15/715,470, filed on Sep. 26, 2017, now Pat. No. 10,961,683, and a continuation-in-part of application No. 16/106,364, filed on Aug. 21, 2018, now Pat. No. 10,656,033.

(60) Provisional application No. 62/640,594, filed on Mar. 9, 2018, provisional application No. 62/640,595, filed on Mar. 9, 2018, provisional application No. 62/640,730, filed on Mar. 9, 2018.

(51) Int. Cl.
*E02F 3/48* (2006.01)
*E02F 3/58* (2006.01)

(52) U.S. Cl.
CPC . *E02F 3/48* (2013.01); *E02F 3/58* (2013.01)

(58) Field of Classification Search
CPC .... D07B 2201/1012; D07B 2201/2001; D07B 2201/2009; D07B 2201/2068; F16G 11/00; F16G 11/02; F16G 11/025; E02F 3/46; E02F 3/48; E02F 3/58; E02F 3/14; E02F 3/60
See application file for complete search history.

(56) References Cited

U.S. PATENT DOCUMENTS 1,992,543 A * 2/1935 Rasmussen ..... E02F 3/304 414/690
2,339,700 A * 1/1944 Huston ..... E02F 3/304 414/690
4,085,854 A * 4/1978 Baron ..... E02F 3/30 414/694
4,473,915 A * 10/1984 Finsterwalder ..... E01D 19/14 14/18
5,400,530 A * 3/1995 Schmidt ..... E02F 3/48 37/396
9,720,198 B2 * 8/2017 Kuffel ..... G02B 6/4471
2005/0109256 A1 * 5/2005 Zaman ..... B63B 21/50 114/230.23
2011/0067220 A1 * 3/2011 Campbell ..... F16G 11/048 29/428
2014/0090279 A1 * 4/2014 Campbell ..... E02F 3/60 37/399
2015/0034891 A1 * 2/2015 Carlson ..... H02G 1/081 254/134.3 R (Continued)

*Primary Examiner* — Jessica H Lutz
(74) *Attorney, Agent, or Firm* — J. Wiley Horton

(57) ABSTRACT

A novel cable construction provided an armored covering over a cable containing high-strength synthetic filaments. The synthetic cable is provided with a strong and tough termination where it attaches to heavy machinery, such as mining machinery. An external armoring is then provided for a desired portion of the cable (up to the entire length of the cable). A collar is preferably provided to seal the end of the armoring portion to a cable jacket (where a cable jacket is present).

14 Claims, 25 Drawing Sheets

(56) References Cited

U.S. PATENT DOCUMENTS

| | | | | |
|---|---|---|---|---|
| 2016/0186407 | A1* | 6/2016 | Campbell | E02F 9/2016 37/399 |
| 2016/0223445 | A1* | 8/2016 | Campbell | D07B 1/185 |
| 2017/0096793 | A1* | 4/2017 | Patenaude | E02F 3/427 |
| 2017/0198530 | A1* | 7/2017 | McFarland | G01D 5/02 |
| 2017/0356481 | A1* | 12/2017 | Campbell | F16G 11/09 |
| 2018/0274202 | A1* | 9/2018 | Plouzek | E02F 9/2016 |
| 2018/0274203 | A1* | 9/2018 | Plouzek | E02F 3/60 |
| 2020/0122982 | A1* | 4/2020 | Van Veluw | B66C 13/02 |

* cited by examiner

CABLE ARMORING SYSTEM

CROSS-REFERENCES TO RELATED APPLICATIONS

This non-provisional patent application claims the benefit of three earlier-filed provisional patent applications. The provisional applications were assigned Ser. Nos. 62/640,594; 62/640,595; and 62/640,730. The present invention and the three referenced provisional applications all list the same inventor. In addition, this non-provisional patent application is a continuation-in-part of U.S. patent application Ser. No. 15/715,470 (now U.S. Pat. No. 10,961,683) and U.S. patent application Ser. No. 16/106,364 (now U.S. Pat. No. 10,656,033).

STATEMENT REGARDING FEDERALLY SPONSORED RESEARCH OR DEVELOPMENT

Not applicable.

MICROFICHE APPENDIX

Not applicable

BACKGROUND OF THE INVENTION

1. Field of the Invention

This invention relates to the field of draglines and power shovels. More specifically, the invention comprises a novel cable construction that allows the use of high-strength synthetic filament cables as a replacement for prior art steel constructions.

2. Description of the Related Art

The present invention proposes to replace some of the chain and wire rope systems used in existing dragline and power shovel operations with high-strength synthetic filament cables. Synthetic filament cable are made of millions of very fine filaments. Each filament is typically smaller in diameter than a human hair. The strength-to-weight ratio of such filaments is much better than the ratio for steel wires. However, synthetic filaments are not very tough. They are quite susceptible to abrasion and cut damage. Thus, synthetic filament cables have not been commonly used in the very hostile environments found in dragline and power shovel operations (typically pit mines).

A prior art dragline bucket is shown in FIG. 1. Dragline bucket assembly 10 is lifted and positioned by a boom crane—typically a very large boom crane. Bucket 24 is nearly always made of thick steel. The width of the bucket's mouth may be as much as twenty feet (6 meters). The bucket itself often weighs many tons.

In operation, the bucket is swung into position and then dropped into the material that is to be removed. The mouth of the bucket is typically given a downward pitch during the drop operation so that it digs into the material. The bucket is then dragged back toward the boom crane. As it is dragged along the bucket's mouth scoops in a load of material. FIG. 1 shows the configuration of the dragline bucket assembly during a typical scooping phase.

Once the bucket is full the boom crane is used to pull the bucket assembly free of the material. The boom crane then swings the bucket toward the area where the scooped material is to be deposited. When the bucket assembly reaches the deposit area, a dumping mechanism causes the bucket to pitch downward. The contents of the bucket then spill from the bucket's mouth. Once the bucket is empty, the cycle repeats.

Bucket 24 and its contents are primarily suspended by a pair of lift trunnion assemblies 22—with a trunnion assembly being located on each side of the bucket. A lower hoist chain 20 connects each trunnion to spreader bar 18. An upper hoist chain 16 connects each side of the spreader bar to yoke 48.

The term "yoke" refers to the component that connects the upper hoist chains to the tensile members used to lift the entire bucket assembly. It is also typically used to connect the chains to the dump block assembly. It can take on many shapes and forms. In the example of FIG. 1, yoke 48 connects upper hoist chains 16 to a pair of lift ropes 14 (Each lift rope 14 is connected to a socket 12). In this context the term "rope" refers to any suitably flexible tensile member. A cable made of wrapped steel wires is often used as a lift rope.

The yoke may be a single large casting or it may be an assembly of several pieces. The term should be broadly construed to mean anything that connects the bucket assembly rigging to the lifting cable(s) leading to the boom on the crane.

As stated previously, the lift ropes connect the bucket assembly to the boom of the crane. Yoke 48 also provides an attachment point for dump block 28. As the name suggests, a mechanism incorporating the dump block is used to change the bucket from its scooping configuration to its dumping configuration. When this mechanism is actuated, the bucket pivots downward about the two trunnion assemblies. The mouth of the bucket pitches downward and the tail of the bucket rises. Once the bucket's contents are completely dumped, the dumping mechanism is reversed and the bucket is returned to its digging orientation.

Still referring to FIG. 1, one or more drag lines 36 are attached to the rigging shown via drag socket 34. A drag line(s) is used to pull the bucket toward the crane once the bucket has been dropped into the material. A drag line is also commonly used to regulate the bucket's orientation. Drag chains 30 connect drag socket 34 to the sides of the bucket. The drag chains attach to bucket 24 on either side of the bucket's mouth. Arch 32 is typically provided to reinforce the bucket's open mouth.

The reader will note that a dump rope 26 passes from the drag socket 34, around dump block 28 and connects to the upper portion of arch 32. The dump rope is used to regulate the transition of the bucket between its digging and dumping orientations.

FIG. 2 shows the same assembly from a different vantage point. The reader will note that each drag chain is attached to the bucket using a large and robust drag chain hitch 40. The lifting chains may be divided into two categories: Lower hoist assembly 44 includes the two lifting chains connecting the trunnions to the spreader bar. The spreader bar itself may also be considered part of the lower hoist assembly. Upper hoist assembly 42 includes the lifting chains used to connect the spreader bar to the yoke. Top rail 38 extends around the top of the open bucket.

The bucket assembly is operated in a brutal environment. The bucket is typically dropped into an ore deposit containing rocks and other abrasive materials. Chains have traditionally been used near the bucket itself because of the extreme forces applied and the abrasive action of the material being dug. The chains shown in the assembly may be comparable in size to the anchor chains used on a large ship. For example, each link may be well in excess of 1 foot (30+ centimeters) long.

Such chains are quite heavy. They must be serviced and replaced often as well. The size and weight of the chains make them difficult and dangerous to handle. In addition, the chains rapidly elongate while in use—primarily because of link-to-link abrasion. This elongation alters the dumping geometry of the bucket assembly and reduces its performance. In addition, the elongation of the lifting chains reduces the maximum height to which the bucket assembly may be lifted. The reduction in lift height reduces the amount of material that the drag-line assembly can move. It would be advantageous to replace the chains with a lighter and less cumbersome material. It would also be advantageous to replace the chains with a tensile member that does not elongate significantly. More information regarding the structure and operation of dragline bucket assemblies is provided in my own co-pending patent application Ser. No. 15/066,162, which is hereby incorporated by reference.

FIG. 3 sows the boom and bucket assembly for a prior art power shovel 118. Boom 120 mounts a pair of dipper arms 122 on either side. The two dipper arms are connected to bucket 124. Bucket 124 includes a floor 126 that may be selectively opened to dump its contents. A power shovel digs by using the dipper arms to scoop the bucket forward and upward in the same manner as an old-fashioned steam shovel. The boom then swings to place the bucket over another position. The bucket's contents are then dumped by opening floor 126.

Boom 120 is raised and lowered using boom ropes 134. The boom is ordinarily not raised or lowered frequently, however. Most of the digging is done by raising and lowering dip arms 122. These are raised and lowered by reeling in and paying off dipper ropes 132. In this particular example, each of the dipper ropes is attached to yoke 128 by passing a loop 136 through passage 140 and securing a dipper rope back to itself with a collar 138. Yoke 128 is connected to the bucket via a pair of trunnions 130 (one on either side).

FIG. 4 depicts a much larger power shovel 118. This type of machine swivels on a turntable 170 that is positioned by the movement of a pair of tracks 172, Boom 120 attaches to cab 169. The boom is held in a stable position by fixed stays 134. Dipper 124 scoops and dumps the material being mined. Dipper 124 is attached in this example to a pair of dipper arms 122. These dipper arms are connected to boom 120 via a rack-and-pinion mechanism that is configured to thrust the dipper forward during the loading portion of the cycle.

Hoist rigging 132 is connected to the dipper via yoke 128. The hoist rigging typically comprises a pair of heavy wire ropes. Each of these wire ropes passes over a top sheave 168, and from that point travels back into cab 169. A winch mechanism in the cab reels in and pays out each of the heavy wire ropes.

Each of the wire ropes may wrap twice around its particular top sheave 168 (in a helical path). FIG. 13 depicts a section view through a pair of top sheaves 168. Helical grooves 208 in each top sheave guide the heavy wire ropes as they pass around the top sheaves.

Returning to FIG. 4, it is also common to provide another set of pulleys on yoke 128 so that a particular hoist rigging wire rope passes from the cab, over its top sheave 168, down to a pulley on yoke 128, back up and over its top sheave 168, and then back to the cab. The wire ropes thus employed must reel in and pay out for every digging cycle.

As those skilled in the art will know, power shovels such as depicted in FIG. 4 often work next to a sheer rock/dirt face that may rise 60 feet or more. The dipper rakes up this face every time it scoops a new load. It is common for dirt and rocks to fall upon every forward part of the machine, including top sheaves 168 and all parts of hoist rigging 132. It is desirable to replace the wire ropes shown in FIG. 4 with the present inventive tensile member. However, one must bear in mind the hostile environment in which this type of machine operates.

FIG. 5 depicts another type of prior art attachment to a power shovel dipper. In this example, dipper ropes 132 pass around a pair of dipper sheaves 190. The dipper sheaves are connected to the dipper via a pair of pivot joints 192.

FIGS. 6 and 7 depict still another type of attachment between a dipper rope and a yoke 128 (with the yoke providing the connection to the power shovel dipper). In this example, saddle 194 is part of the large steel casting that forms the yoke. Shoulder 198 is formed on the top of the yoke. Dipper rope 132 is formed into a loop and passed under saddle 194 and over shoulder 198. A series of threaded bolt holes 196 are provided in the forward face of the saddle.

FIG. 7 provides a sectional elevation view through the assembly in FIG. 6. Retainer 200 is clamped to the front face of saddle 194 by passing bolts 202 through holes in the retainer and into the threaded bolt holes in the forward face of the saddle. The dipper rope 132 is thereby trapped against the saddle. However, in many cases it is left free to slide somewhat in order to equalize the load.

The hostile environment of mining and similar industries makes the use of light-weight flexible tensile members difficult. The advantages of using such tensile members are promising, however. Any reduction in the weight of the bucket rigging means that a larger bucket can be used (for a given crane lifting capacity) and more fill material can be carried with each scoop. Any reduction in the stretching tendency of the tensile members used means that the assembly produces a more consistent bucket fill and soil mound height, thus increasing productivity. Any reduction in metal-to-metal wear increases the lifespan of a component and reduces the frequency of component replacement. Any reduction in the use of chain reduces the safety hazards inherent in the use of chain. Thus, a new type of flexible tensile member assembly that is able to withstand the hostile environment common to mining machinery would be advantageous. A new type of flexible tensile member assembly that is able to employ modern synthetic materials would further reduce the weight of the rigging and provide an even greater advantage.

Steel chains and cables are typically used for both dragline and power shovel operations. Steel provides toughness in such a hostile environment, where dust, abrasion, and substantial impacts are common. Synthetic filament cables would provide a substantial weight savings over steel. These include cables made of DYNEEMA, SPECTRA, TECHNORA, TWARON, KEVLAR, VECTRAN, PBO, carbon fiber, and glass fiber (among many others). In general the individual filaments have a thickness that is less than that of human hair. The filaments are very strong in tension, but they are not very rigid. They also tend to have low surface friction. These facts make such synthetic filaments difficult to handle during the process of adding a termination and difficult to organize.

Hybrid cable designs are also emerging in which traditional materials are combined with high-strength synthetic materials. These present additional challenges, since the metal portions may be quite stiff while the synthetic portions will not be.

The present invention provides an armored cable construction permitting synthetic filament (and potentially hybrid) cables to be used in hostile working environments such as dragline and power shovel operations.

BRIEF SUMMARY OF THE PRESENT INVENTION

The present invention comprises a novel cable construction provided an armored covering over a cable containing high-strength synthetic filaments. The synthetic cable is provided with a strong and tough termination where it attaches to heavy machinery, such as mining machinery. An external armoring is then provided for a desired portion of the cable (up to the entire length of the cable). A collar is preferably provided to seal the end of the armoring portion to a cable jacket (where a cable jacket is present).

REFERENCE NUMERALS IN THE DRAWINGS

Figure 1:
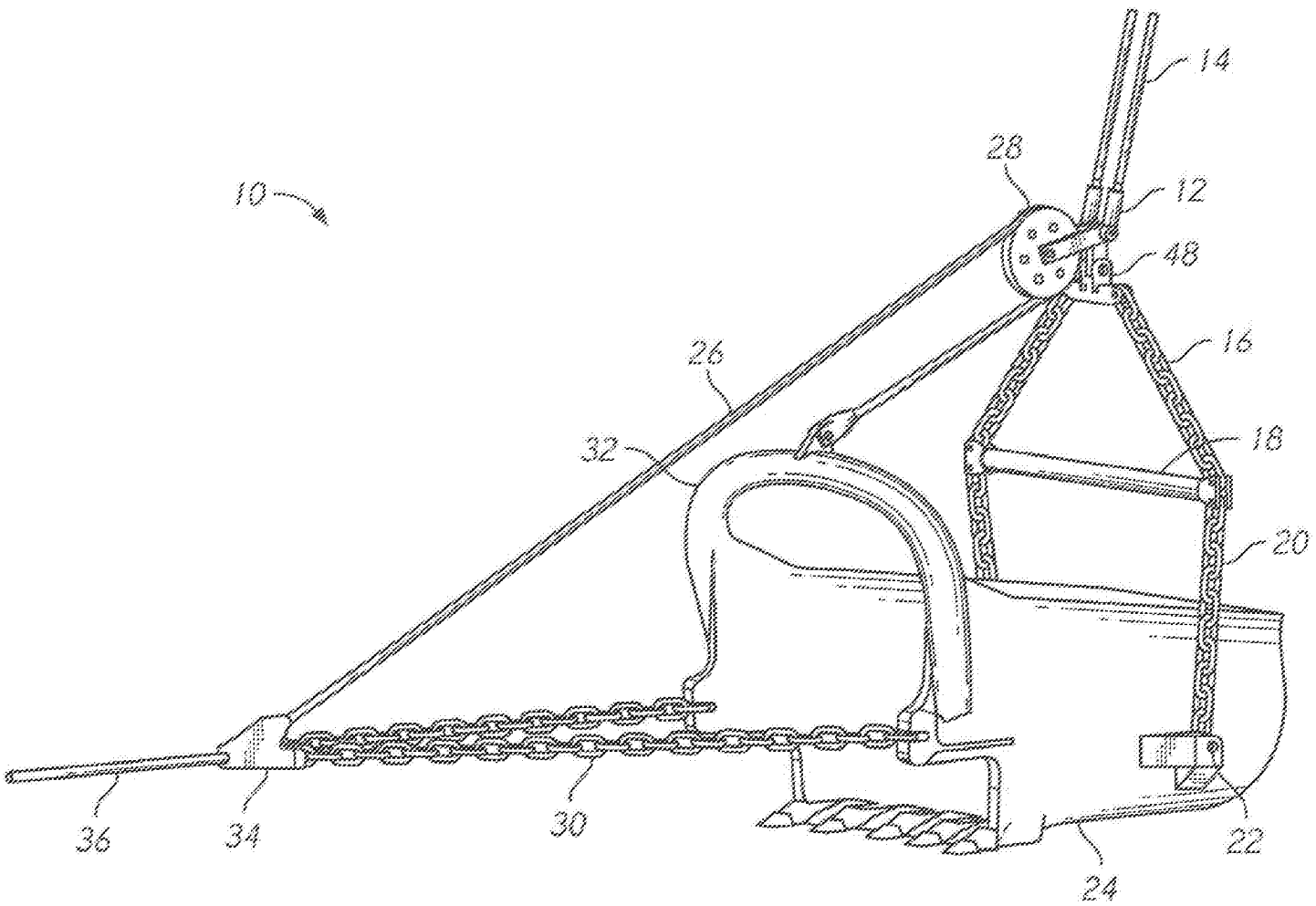
FIG. 1 (Prior Art)
FIG. 1 is a perspective view showing a prior art dragline bucket and its associated lifting and dumping rigging.
Figure 2:
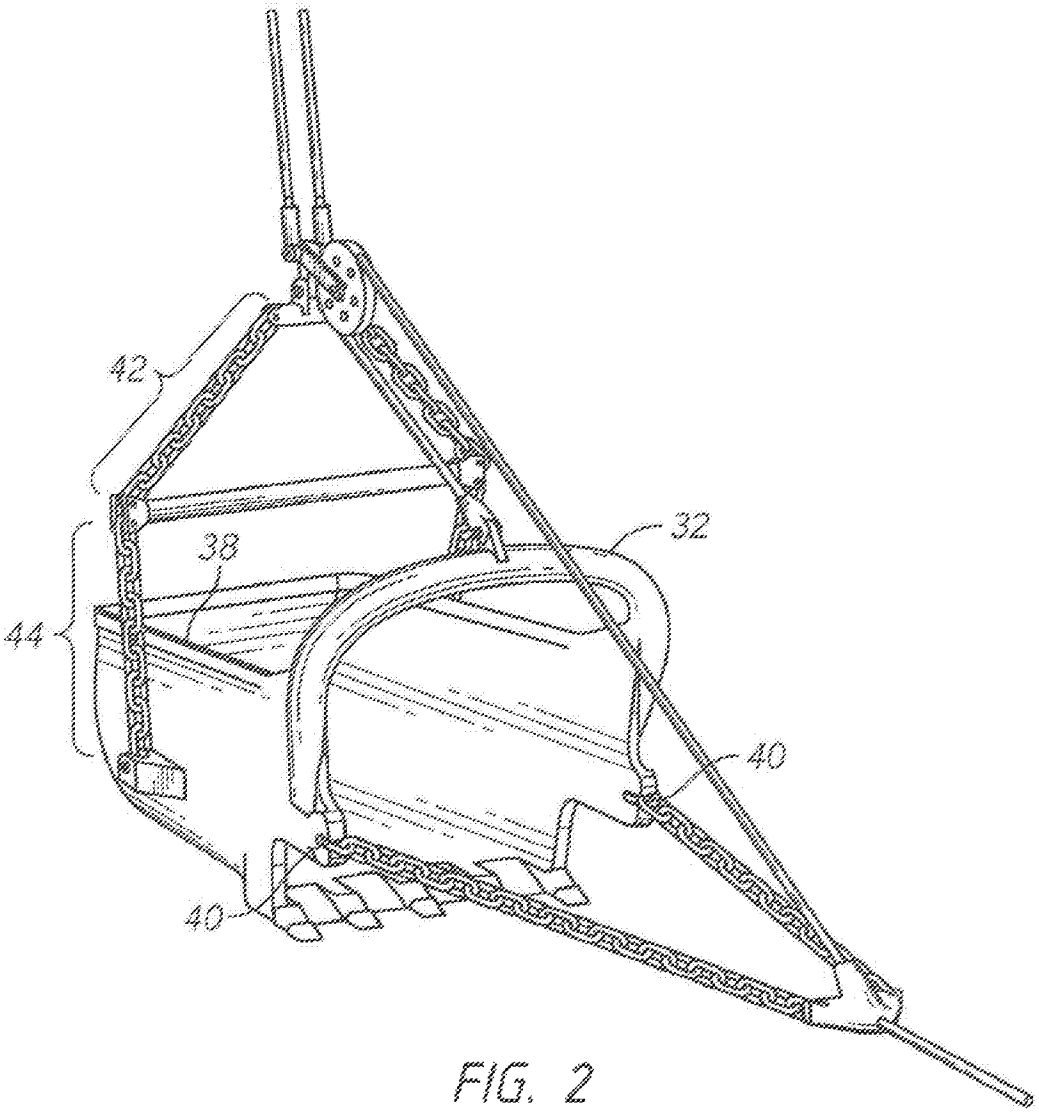
FIG. 2 (Prior Art)
FIG. 2 is a perspective view, showing the assembly of FIG. 1 from a different vantage point.
Figure 3:
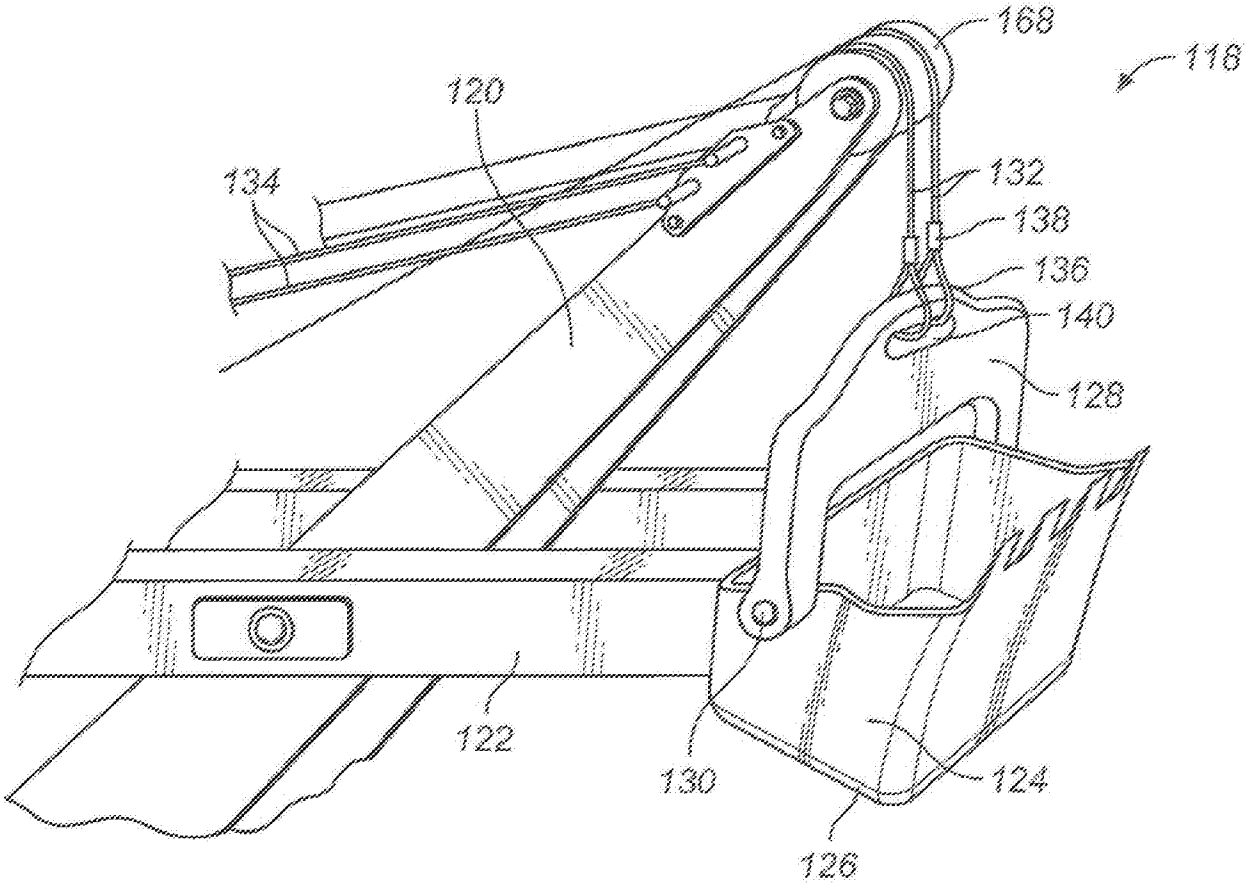
FIG. 3 (Prior Art)
FIG. 3 is a perspective view, showing a prior art power shovel.
Figure 4:
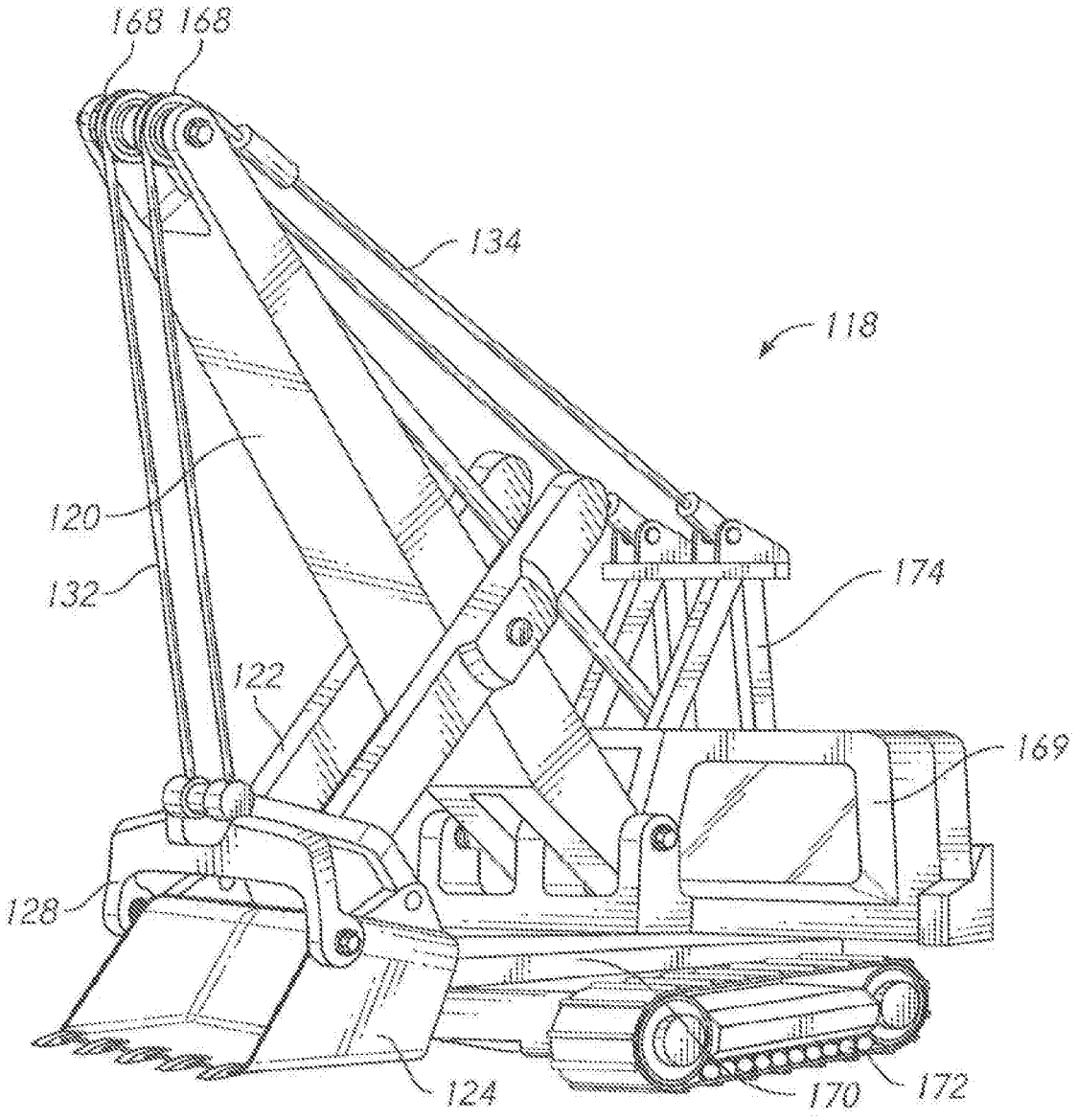
FIG. 4 (Prior Art)
FIG. 4 is a perspective view, showing another type of prior art power shovel.
Figure 5:
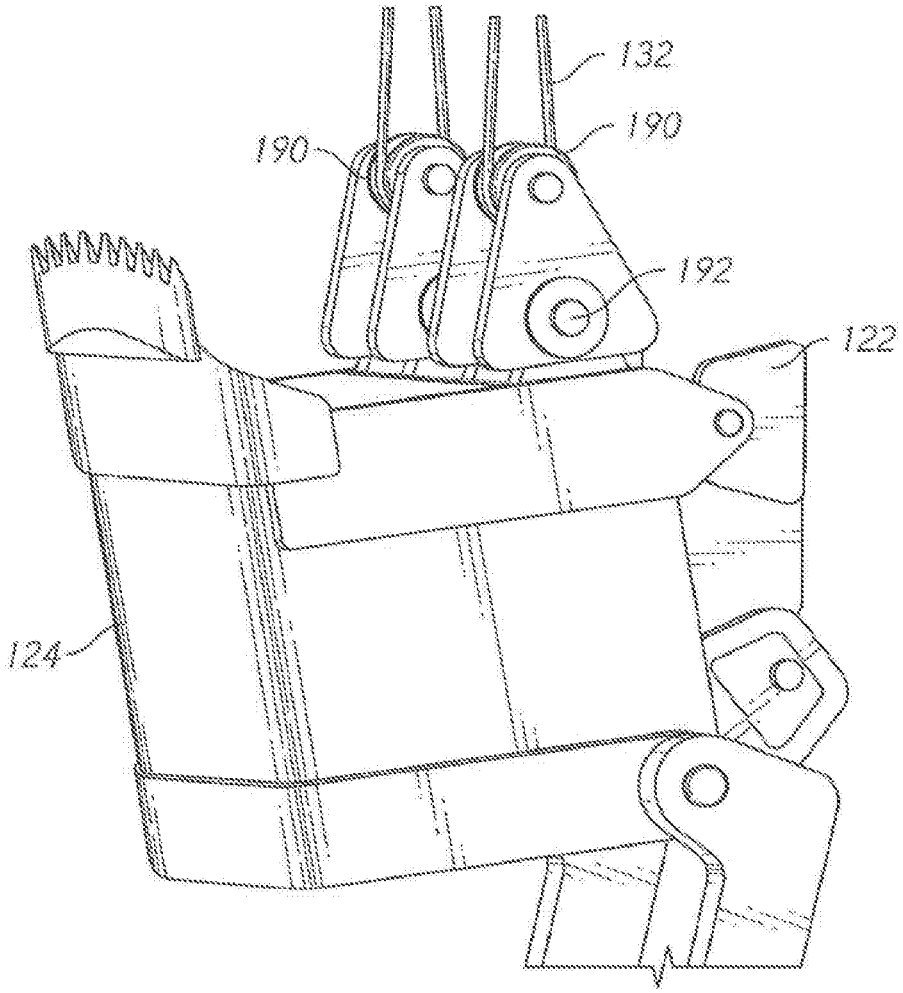
FIG. 5 (Prior Art)
FIG. 5 is a detailed perspective view, showing an exemplary attachment between a prior art dipper rope and a dipper.

10 dragline bucket assembly
12 hoist socket
14 lift rope
16 upper hoist chain
18 spreader bar
20 lower hoist chain
22 lift trunnion
24 bucket
26 dump rope
28 dump block
30 drag chain
32 arch
34 drag socket
36 dragline rope
38 top rail
40 drag chain hitch
42 upper hoist assembly
44 lower hoist assembly
48 yoke
50 point sheave
52 cab
54 A frame
56 mast
58 boom
60 hoist drum
62 dragline drum
64 deflection sheave
66 deflection sheave
68 bridge support rope
70 termination
72 bend restrictor
74 bend restrictor half
76 jacket
78 jacket clamp
80 bolt flange
82 clamp receiver
84 inspection region
86 bolt flange
88 mounting hole
90 threaded receiver
92 bolt
94 band clamp
96 collector
98 anchor
100 strand
102 attachment features
104 cable
106 flange
108 drive motor
110 reduction gear
112 encoder
114 control unit
116 nozzle
118 power shovel

120 boom
122 dipper arm
124 bucket
126 floor
128 yoke
130 trunnion
132 dipper rope
134 boom rope
136 loop
138 collar
140 passage
142 termination
144 attachment fixture
146 cable armoring
148 collar
150 jacketed cable
152 cavity
154 potted region
156 interlock
158 interlock
159 O-ring
160 stranded core
162 jacket
164 gap
165 strap
168 top sheave
169 cab
170 turntable
172 track
174 A-frame
178 hoist rigging
190 sheave
192 pivot joint
194 saddle
196 bolt hole
198 shoulder
200 retainer
202 bolt
204 coupler
206 wire rope
208 helical groove
210 brush assembly
212 insert
214 strand jacket
216 bases instrument unit
218 mid-span instrument unit
220 tip instrument unit
222 lift rope junction
224 dragline junction
226 wire rope junction

DETAILED DESCRIPTION OF THE INVENTION

Figure 8:
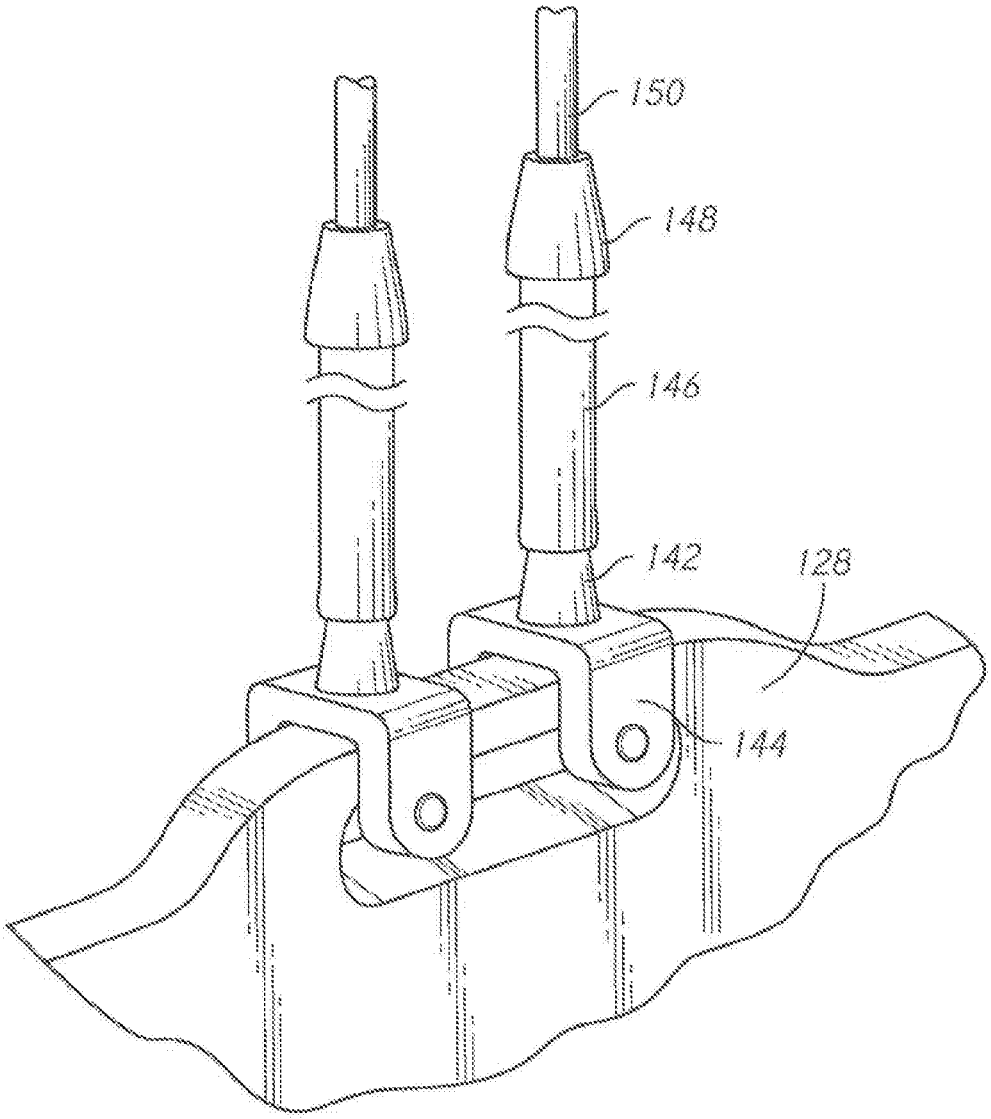
FIG. 8 is a perspective view, showing a connection to a yoke using the present invention.

FIG. 8 shows one approach to using a synthetic cable for the rigging on a dragline or a power shovel. FIG. 8 shows the example of a power shovel. Jacketed cables 150 each include a synthetic filament core surrounded by an encapsulating jacket. The jacket organizes the cable and provides protection from external contaminants and from sunlight. However, it is not nearly durable enough to withstand the harsh environment near the dipper bucket on its own. Cable armoring 146 is added near the dipper. In this example, the armoring extends up the cable until it reaches a portion of the cable which must pass over top sheave 168. Each cable passes over the top sheave as the bucket is raised and lowered. When the bucket is raised to its maximum height, the armoring in this example stops just short of the top sheave.

In this example each cable is terminated into a heavy steel piece (attachment fixture 144). This creates a suitable termination 142 on the end of each cable. Each attachment fixture 144 is made of steel and is quite durable. These are connected to yoke 128 using steel pins. Cable armoring 146 covers and protects the jacketed cables 150 from the point each cable emerges from its respective termination up to a collar 148.

Collar 148 provides a protective seal between the jacketed cable and its cable armoring. It prevents the ingress of dust, fine debris, liquids, and other contaminants. The collar may be of a split configuration that is clamped in place using transverse bolts.

Figure 9:
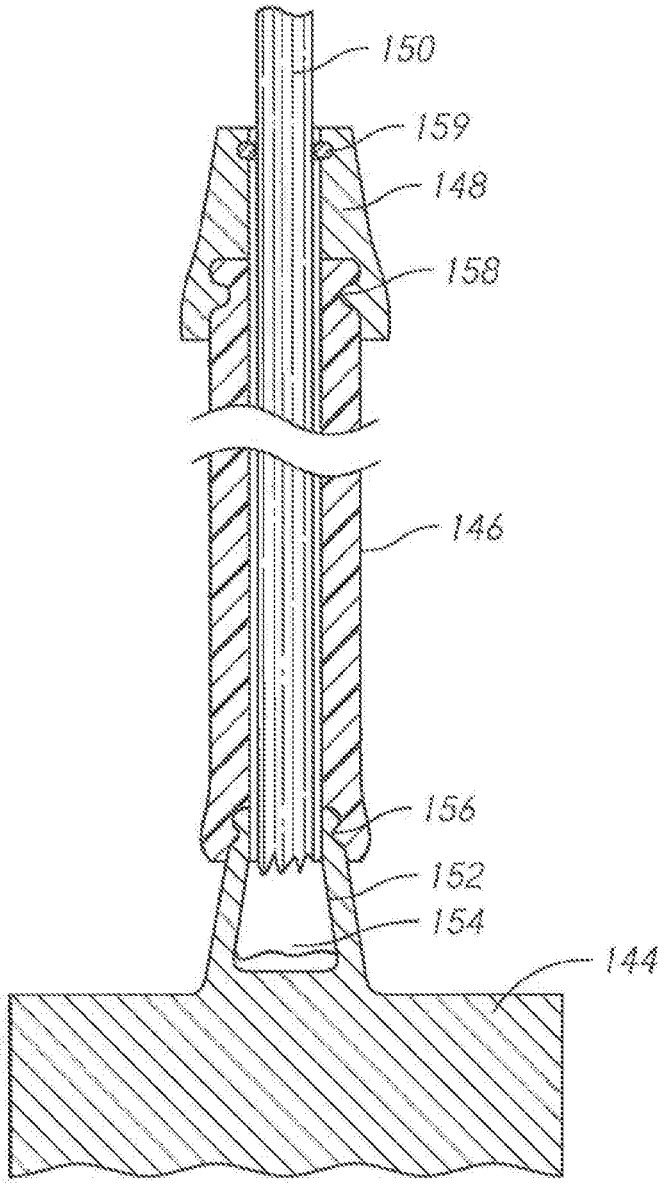
FIG. 9 is a sectional elevation view, showing additional details of the configuration of FIG. 8.

FIG. 9 shows a sectional elevation view through one cable assembly. In this version attachment fixture 144 includes a cavity 152. A length of cable filaments are potted into this cavity to form potted region 154. This creates a mechanical interlock between the end of jacketed cable 150 and attachment fixture 144.

A single potted region is shown. In reality, multiple potted connections may be made between individual filament groupings and attachment fixture 144. This type of design is described in detail in my co-pending U.S. application Ser. No. 14/693,811, which is hereby incorporated by reference.

Cable armoring 146 is added over the outside perimeter of jacketed cable 150. The cable armoring is preferably a very tough and cut-resistant material. A good example is fiber-reinforced rubber. Interlock 156 is provided between the lower end of the cable armoring and the attachment fixture. Interlock 158 is also provided between the upper end of the cable armoring and the lower end of collar 148.

Collar 148 seals around the jacketed cable. O-ring 159 is preferably provided to make a positive seal between the collar and jacketed cable 150. This prevents the ingress of dust, water, and other contaminants. Although no gap is shown between the exterior of the jacket and the interior of the cable armoring a significant gap may in fact be present in many applications. In those instances it may be necessary to connect the armoring to the attachment fixture using a split clamping ring attached by transverse bolts. A second split clamping ring may be used at the top of the cable armoring as well.

Figure 10:
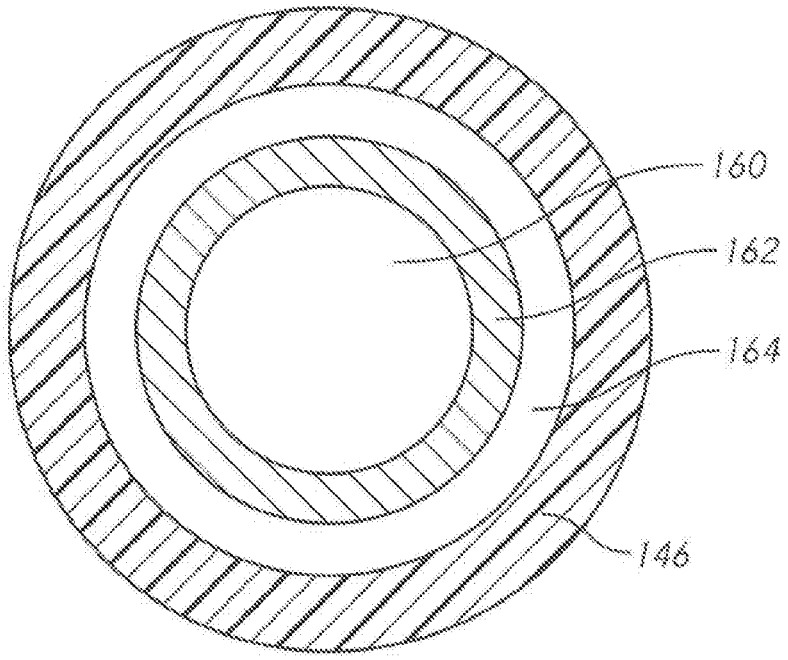
FIG. 10 is a sectional view showing an exemplary construction of a tensile member made according to the present invention.

FIG. 10 shows a cross-section through a jacketed cable with an armoring layer added. Stranded cores 160 comprises the high-strength synthetic filaments (some conventional steel wires may also be included). Jacket 162 fits tightly around this core. Cable armoring 146 is a thick and tough layer. As stated previously, it may be made of a natural or synthetic rubber reinforced by another material such as steel wires or fiberglass. It may also be made of a flexible urethane. In this example, gap 146 is provided between the interior of the cable armoring and the exterior of the jacket in this example. This gap allows the cable to bend and flex without chafing against the interior of the armor layer. The gap may be filled by another material such as a woven cloth layer.

Figure 11:
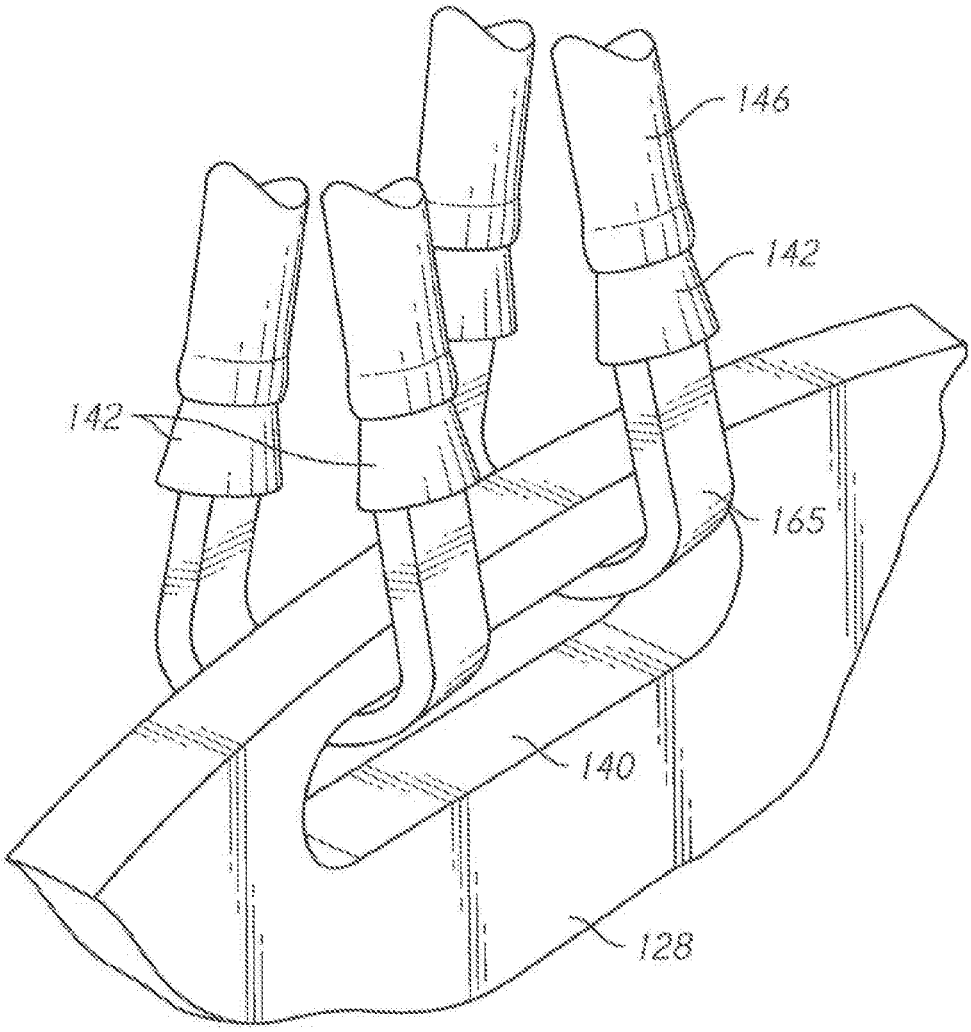
FIG. 11 is a perspective view, showing a connection to a yoke using the present invention.

FIG. 11 shows an alternate embodiment for attaching the inventive cable to yoke 128 of a power shovel. In this instance four separate synthetic cables are used. Each pair of synthetic cables is terminated to a steel strap 165. The steel strap passes through passage 140 to connect to the yoke and thereby connect to the bucket assembly.

Figure 6:
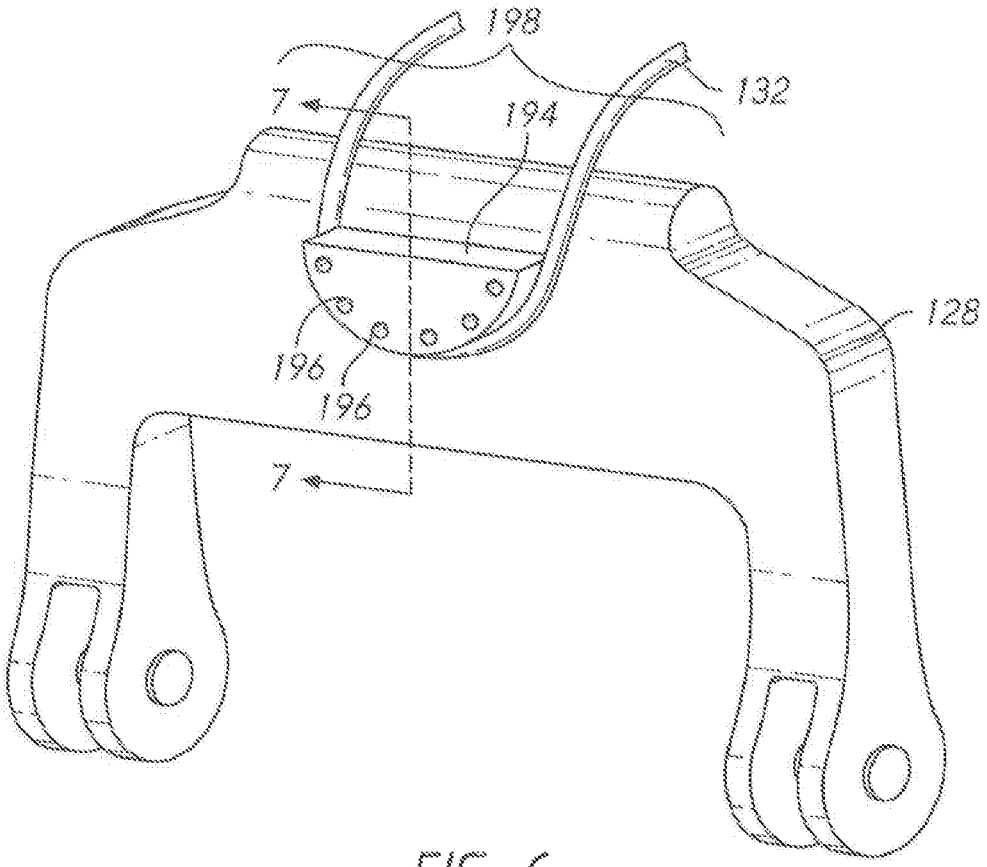
FIG. 6 (Prior Art)
FIG. 6 is a perspective view, showing another exemplary attachment between a prior art dipper rope and a yoke.
Figure 7:
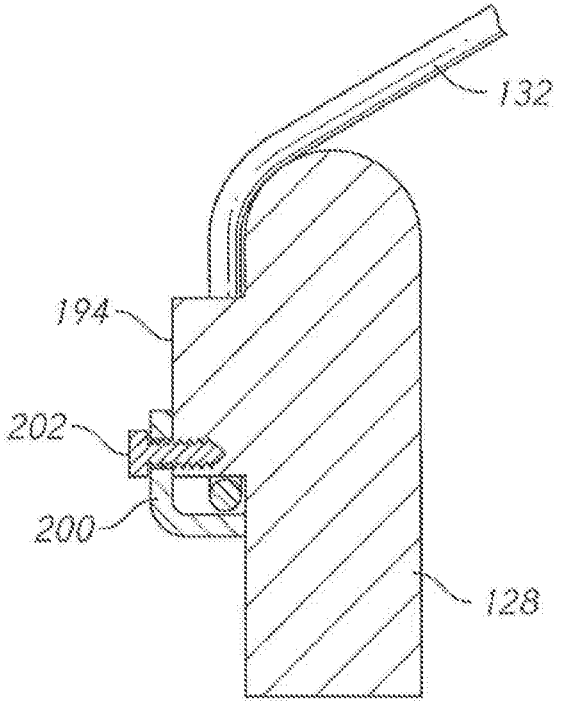
FIG. 7 (Prior Art)
FIG. 7 is a sectional elevation view, showing additional details of the prior art attachment depicted in FIG. 6.
Figure 12:
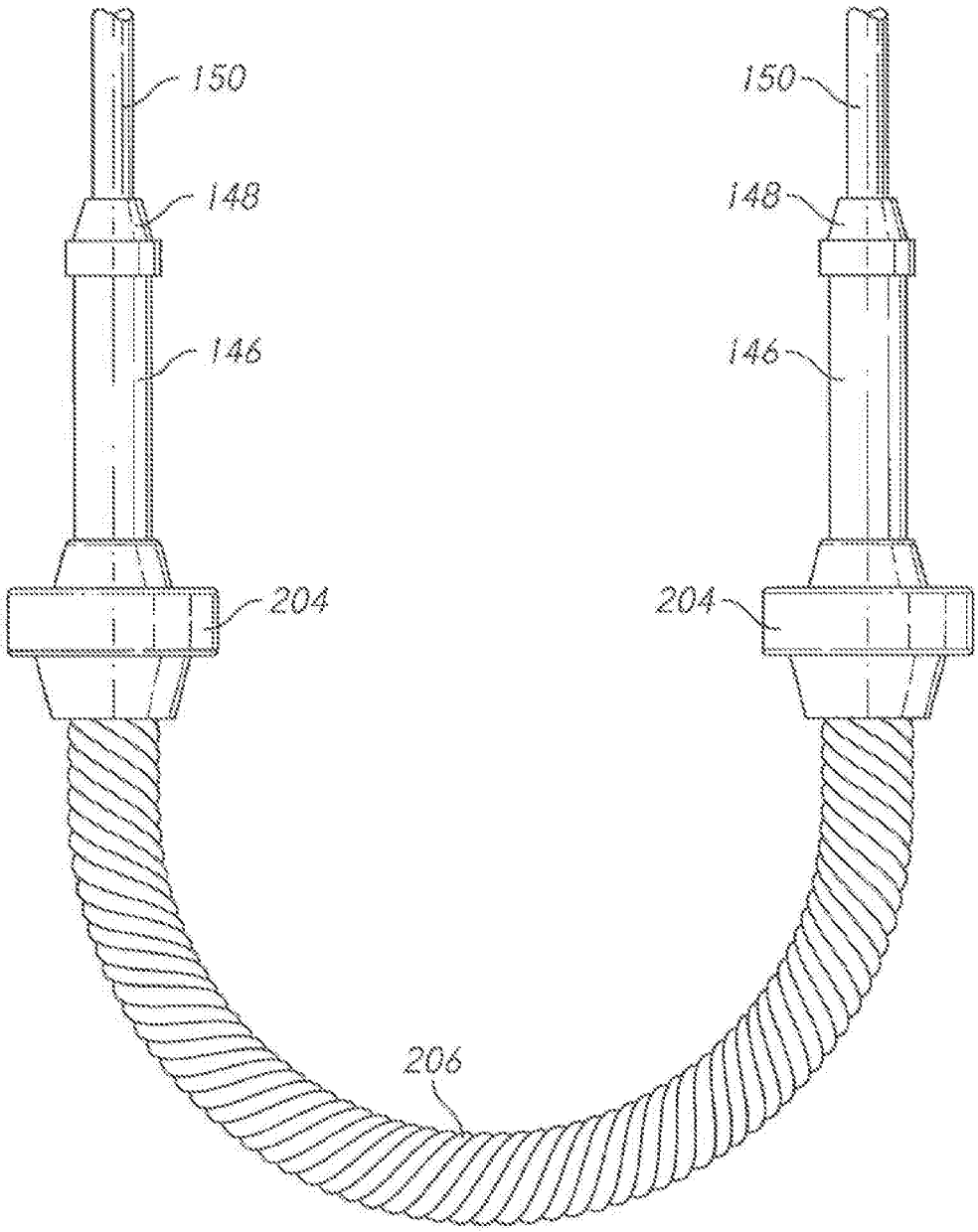
FIG. 12 is an elevation view, showing another embodiment of the present invention.

FIG. 12 shows still another embodiment of the present invention that is configured for use with a yoke assembly such as depicted in FIGS. 6 and 7. Wire rope 206 is a length of conventional steel strands formed into a loop to pass around saddle 194 (depicted in FIG. 6) and over shoulder 198. Returning to FIG. 12. Couplers 204 connected jacketed synthetic cable 150 to wire rope 206. As an example, each coupler may contain a potted termination to the synthetic cable on one side and a spelter type socket attaching to the wire rope on the other.

Cable armoring 146 is provided over a length of the cable in proximity to the dipper. Collar 148 seals the armoring to jacketed cable 150 at the point of termination for the cable armoring. Cable armoring 146 is likewise sealed to coupler 204 on its opposite end.

In some embodiments the cable armoring will extend from the dipper attachment up and over the top sheaves. In other instances, a separate length of cable armoring may be provide in the vicinity of the top sheaves.

Figure 13:
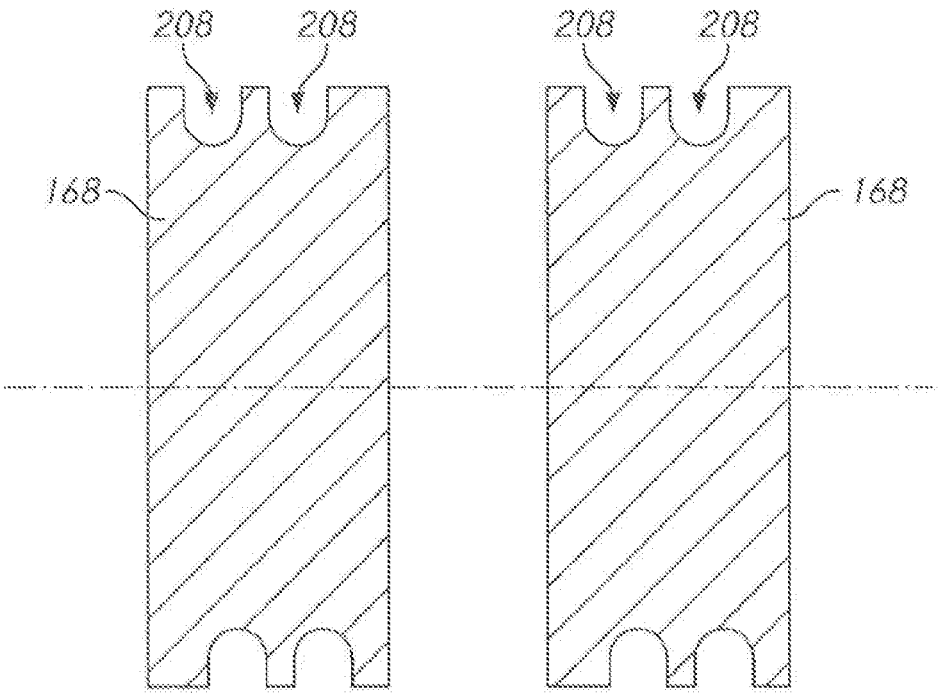
FIG. 13 (Prior Art)
FIG. 13 is a sectional elevation view, showing an exemplary prior art top sheave.
Figure 14:
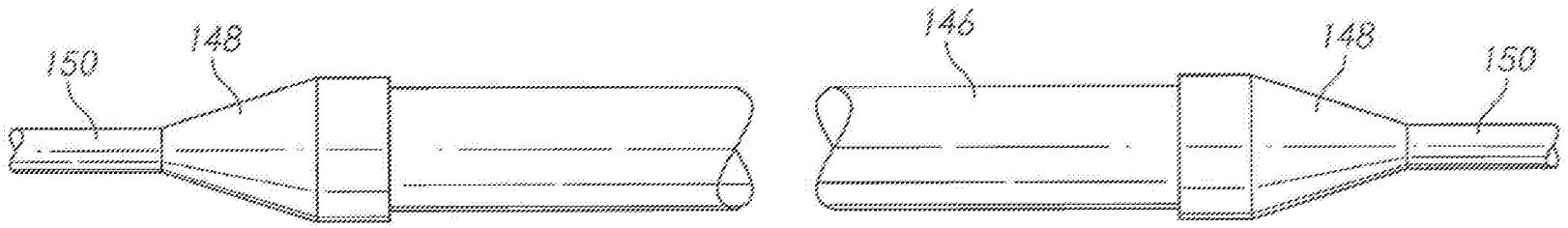
FIG. 14 is an elevation view, showing another embodiment of the present invention.

Returning again to FIG. 13, the reader will recall how each top sheave includes a helical groove 208 configured to guide the cable's path as it is reeled in and payed off. FIG. 14 depicts an embodiment in which a length of armoring has been provided to cover the section of the cable that passes around the top sheave. Cable armoring 146 exists between two collars 148 on an intermediate portion of jacketed cable 150 (rather than a portion proximate an end of cable 150).

Having provided a disclosure of the invention and some of its applications, the following additional principles should also be known:

1. The inventive methods and hardware has been described with respect to two examples of mining machinery—power shovels and dragline cranes. However, the invention is applicable to other forms of mining machinery and beyond the mining industry as well. As an example, the invention is applicable to any field where armoring of a flexible tensile member is desirable.

2. The armor layer or layers may be made removable over some or all of the tensile member's length. This may be done to facilitate inspection of the underlying synthetic core components.

3. Some "grip" engagement between the core and the armor layer will be desirable in some circumstances. As an example, the inward facing surface of the armor layer could be given a gripping texture (ribs or helical grooves) so that the armor layer does not slip with respect to the core in a region where the tensile member passes over a sheave. In such a situation surface shearing forces are preferably transmitted from the armor layer to the core layer in order to prevent the armor layer slipping like a sock. It is also possible to provide outward facing gripping surfaces on the core layer or on the jacket material surrounding the core layer.

4. Another type of gripping feature between the core and the armor layer can be cross-stitching or some form of adhesive.

5. It is desirable to provide an armor layer that indicates a breach or other significant damage to the protection it affords. As a first example the armor material may include a brightly colored layer covered by a dark layer. A gouge or a split then becomes visible as a bright portion against a dark background. For embodiments in which the armor layer is sealed to a termination at both ends of a tensile member, a brightly dyed fluid can be placed between the armor layer and the core layer. This bright fluid will seep out of any breach in the armor layer and indicate a problem.

6. An armor layer may be provided on an intermediate portion of the tensile member rather than proximate the ends. As one example, an armor layer may be provided for a region of the tensile member that passes back and forth over a top sheave.

7. An armor layer may be provided on a length of core that is passed around a spliced termination (such as a large thimble-type device) and woven back into itself. The armor layer could cover the terminated portion and the woven portion.

Figure 15:
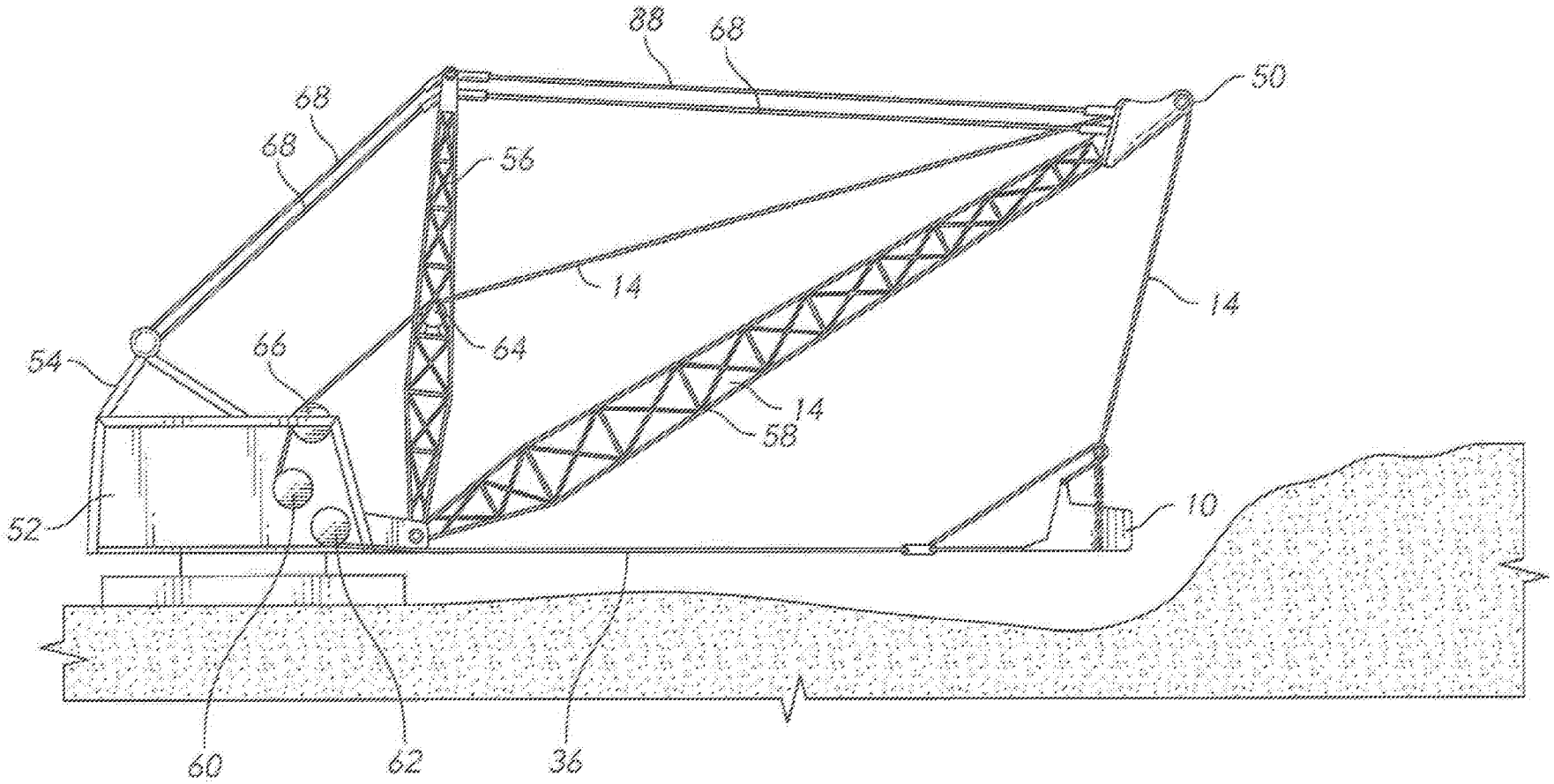
FIG. 15 (Prior Art)
FIG. 15 is an elevation view, showing a prior art dragline crane.

It is helpful to consider the application of the present inventive hardware to prior art heavy equipment. FIG. 15 shows a prior art dragline crane. Cab 52 is mounted on walking shoes that slowly move the machine from one location to the next. A turntable is provided so that the cab can swivel.

Boom 58 is pivotally mounted to the cab. It extends for a large distance. For very large machines the boom may be as long as 100 meters. Mast 56 extends upward as shown. Multiple bridge support ropes 68 maintain the boom's position. A first group of bridge support ropes connects the top of mast 56 to the tip of boom 58. A second group of bridge support ropes 68 connect the top of mast 56 to A-frame 54 on the cab.

Bucket assembly 10 actually does the digging and scooping. The weight of the bucket (and its contents) is supported by lift rope 14 (which may be two or more ropes rigged in parallel). Lift rope 14 passes over point sheave 50 and back to hoist drum 60 within the cab. Deflection sheaves 64,66 redirect the path of the hoist rope as needed. Dragline rope 36 pulls the bucket toward the cab. It is reeled in and paid out by dragline drum 62.

Bridge support ropes 68 are conventionally thought of as "fixed" or "standing" rigging in that they are not reeled in and paid out (in this context such a tension member will be referred to generally as a "stay"). This does not mean, however, that they are not subjected to dynamic forces. As lift rope H is reeled in to lift the bucket, the tension on bridge support ropes 68 increases substantially. Once the scooping phase is done, the entire crane pivots to the dumping area. This swinging motion places lateral loads on the bridge support ropes. When the bucket is dumped the load on the bridge support ropes is suddenly and significantly reduced.

In these various motions the boom tends to bounce and sway. Bridge support ropes 368 undergo bouncing motions constantly. In some instances they will experience circular as well as lateral oscillations. The motions are best visualized as waves. Principles of superposition can produce violent motion in some instances. These violent motions are difficult to predict. The fixed rigging for these types of heavy machines has traditionally been made from heavy wire rope. Wire rope is quite tough. It is also capable of repeated elastic deformation without significant damage. Wire rope also provides good damping characteristics. The steel wires making up the rope provide reasonable damping. In addition, as most wire ropes are helically laid, the layered helices themselves provide good damping characteristics by twisting and untwisting.

High-strength synthetic filaments offer potential advantages over the use of wire rope. These filaments have a much higher strength-to-weight ratio. If one can reduce the weight of the cable rigging in a large earth moving machine, the weight saving translates directly into additional payload. There is therefore a real incentive to use advanced synthetic filaments instead of steel wire in a tensile strength member in a large piece of equipment.

A tensile strength members must be connected to other components in order to be useful. For example, a cable used in a hoist generally includes a lifting hook on its free end.

This lifting hook may be rigged to a load. The assembly of an end-fitting and the portion of the cable to which it is attached is generally called a "termination."

A tough steel lifting hook is commonly attached to a wire rope to create a termination. A "spelter socket" is often used to create the termination. The "spelter socket" involves an expanding cavity within the end-fitting. A length of the wire rope is slipped into this cavity and the individual wires are splayed apart. A liquid potting compound is then introduced into the expanding cavity with the wires in place. The liquid potting compound transitions to a solid over time and thereby locks the wire rope into the cavity.

The potting compound used in a spelter socket is traditionally molten lead and—more recently—is more likely a high-strength epoxy. However, the term "potting compound" as used in this description means any substance which transitions from a liquid to a solid over time. Examples include molten lead, thermoplastics, and UV-cure or thermoset resins (such as two-part polyesters or epoxies). Other examples include plasters, ceramics, and cements. The term "solid" is by no means limited to an ordered crystalline structure such as found in most metals. In the context of this invention, the term "solid" means a state in which the material does not flow significantly under the influence of gravity. Thus, a soft but stable wax is yet another example of such a solid.

The prior art approaches to adding a termination to a cable are explained in detail in commonly-owned U.S. Pat. Nos. 7,237,336; 8,048,357; 8,236,219 and 8,371,015. These prior patents are hereby incorporated by reference. The prior art approaches are also explained in detail in commonly-owned U.S. patent application Ser. Nos. 13/678,664 and 15/710,692. These published pending applications are also hereby incorporated by reference.

Many different high-strength synthetic filaments are now known. Examples include DYNEEMA (ultra-high-molecular-weight polyethylene), SPECTRA (ultra-high-molecular-weight polyethylene), TECHNORA (aramid), TWARON (p-phenylene terephthalamide), KEVLAR (para-aramid synthetic fiber), VECTRAN (a fiber spun from liquid-crystal polymer), PBO (poly(p-phenylene-2,6-benzobisoxazole)), carbon fiber, and glass fiber (among many others). In general the individual filaments have a thickness that is less than that of human hair. The filaments are very strong in tension, but they are not very rigid and they are not very tough. They offer potential weight savings over traditional wire rope but they also require additional methodologies and hardware to allow them to survive in a hostile environment such as a pit mine.

Tensile members made predominantly from synthetic filaments are very strong in tension but weak in abrasion resistance, cut resistance, and transverse shear resistance (The word "predominantly" is used because it is known to provide hybrid cables that include both metallic components and synthetic components). This invention disclosure describes hardware and methods that are useful in adapting tensile strength members including synthetic filaments to a harsh environment. The hardware and methods are primarily directed toward synthetic cables, but the reader should bear in mind that these techniques are advantageous for traditional wire ropes in some circumstances as well.

Figure 16:
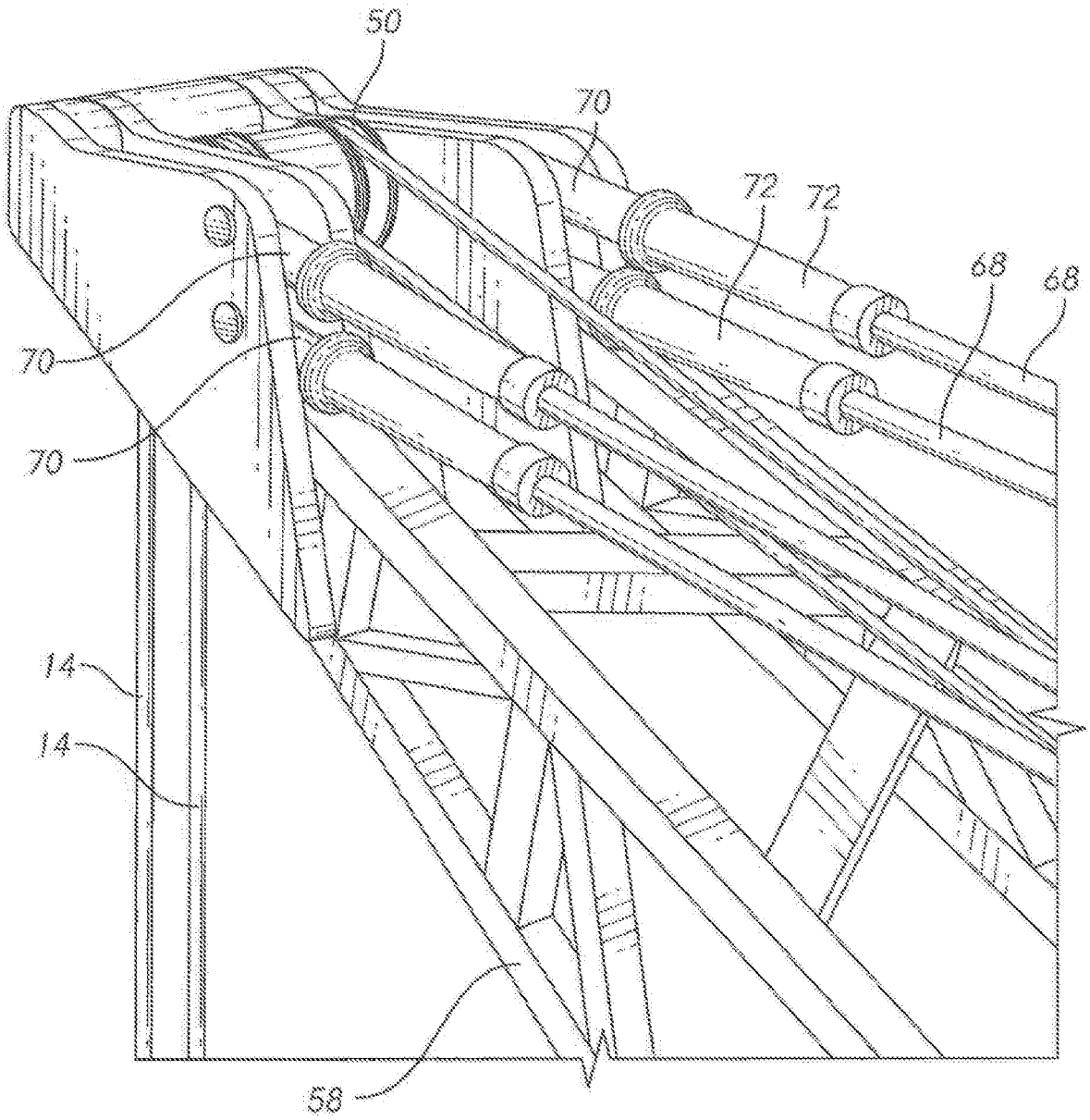
FIG. 16 (Prior Art)
FIG. 16 is a perspective view, showing the region of the point sheave for the crane of FIG. 15.

FIG. 16 shows a detailed view of a particular area of the prior dragline crane shown in FIG. 15. The view centers on the area of point sheave 50—located near the very tip of boom 58. In this example four separate bridge support ropes 68 carry the weight of the boom and the loads imposed by lift ropes 14 (which raise and lower the bucket). The term "rope" is a traditional term used within the heavy equipment industry. In this context the term rope is a synonym for a cable or any other term referring to a tensile strength member.

Each bridge support rope is made primarily (if not fully) from high-strength synthetic filaments. Each of the four bridge support ropes ends in a termination 70. Each termination in this example is connected to the boom by a large transverse pin. Bend restrictors 72 provide a transition between the freely flexing portion of the rope and the portion that is rigidly locked within the termination. In this example, each bend restrictor 72 is approximately 3 meters long. The forces involved in such an assembly are tremendous.

Figure 17:
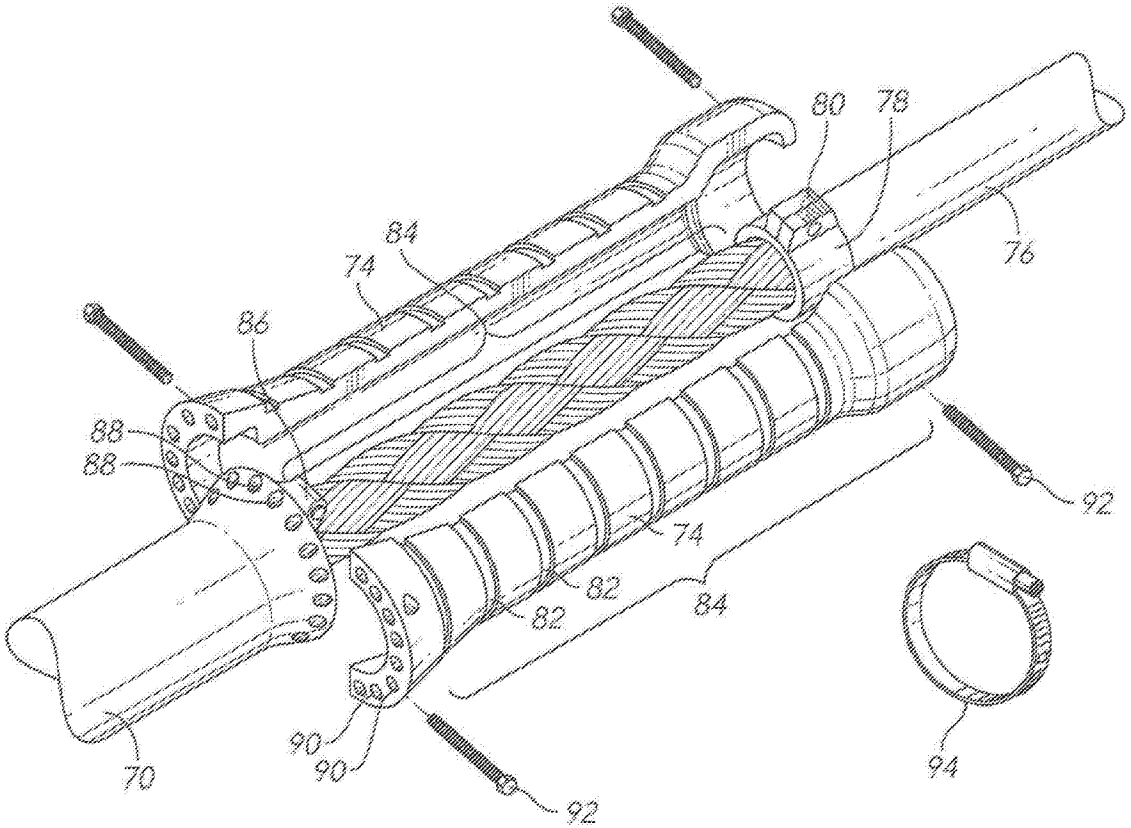
FIG. 17 is an exploded perspective view, showing an inspection region for a bridge support rope on a dragline crane.

FIG. 17 provides additional details concerning the cables, the terminations, and the bend restrictors employed. In the state shown in FIG. 17, inspection region 84 of the cable is fully accessible. The strands and filaments themselves are accessible, as jacket 76 (a protective sleeve covering the cable) stops at jacket clamp 78.

In order to reassemble the exploded assembly depicted in FIG. 17, the user may start by urging the two bend restrictor halves 74 together (The word "may" is used because more than one order of assembly is possible). The user then inserts the four transverse bolts 92. Each bolt 92 passes through a hole in one bend restrictor half and threads into a threaded receiver in the opposite bend restrictor half. The hole in each restrictor half includes a counterbore with a bearing face. The head of each bolt bears against the bearing face of a counterbore as the bolt is tightened—thereby pulling the two bend restrictor halves together.

The two bend restrictor halves are properly positioned with respect to termination 70 by that face that the bolts 92 slide through bolt receiver 86 on the termination and bolt flange 80 on jacket clamp 78. A stronger connection between the termination and the bend restrictor is preferred, however. To that end, numerous bolts are passed through mounting holes 88 in the termination and into threaded receivers 90 on the bend restrictor halves. These bolts create a very strong flange-type connection.

The two bend restrictor halves are preferably made of a very tough yet somewhat elastic material. In the embodiment shown, the two halves are made of molded urethane. While urethane is indeed a tough material, the reader should bear in mind that the tension on the cable will often be enormous and the lateral flexure loads are also quite substantial. These loads will tend to buckle and separate the two bend restrictor halves.

In order to strengthen the assembly, a series of clamp receivers 82 are provided on the exterior surface of the bend restrictor halves. Each clamp receiver is a groove having a rectangular cross section. Once the two halves are united, a band clamp 94 is opened, passed around the two halves, and secured in each clamp receiver. The example shown provides enough receivers to accommodate eight band clamps 94. Once these band clamps are tightened, the assembly becomes much stronger.

The tightened assembly is placed in service and remains in service for a defined interval. Once the interval is completed, the bend restrictor must be opened to facilitate inspection of the cable. The band clamps are removed and the two bend restrictor halves are disassembled. Inspection region 84 is thereby exposed.

Figure 18:
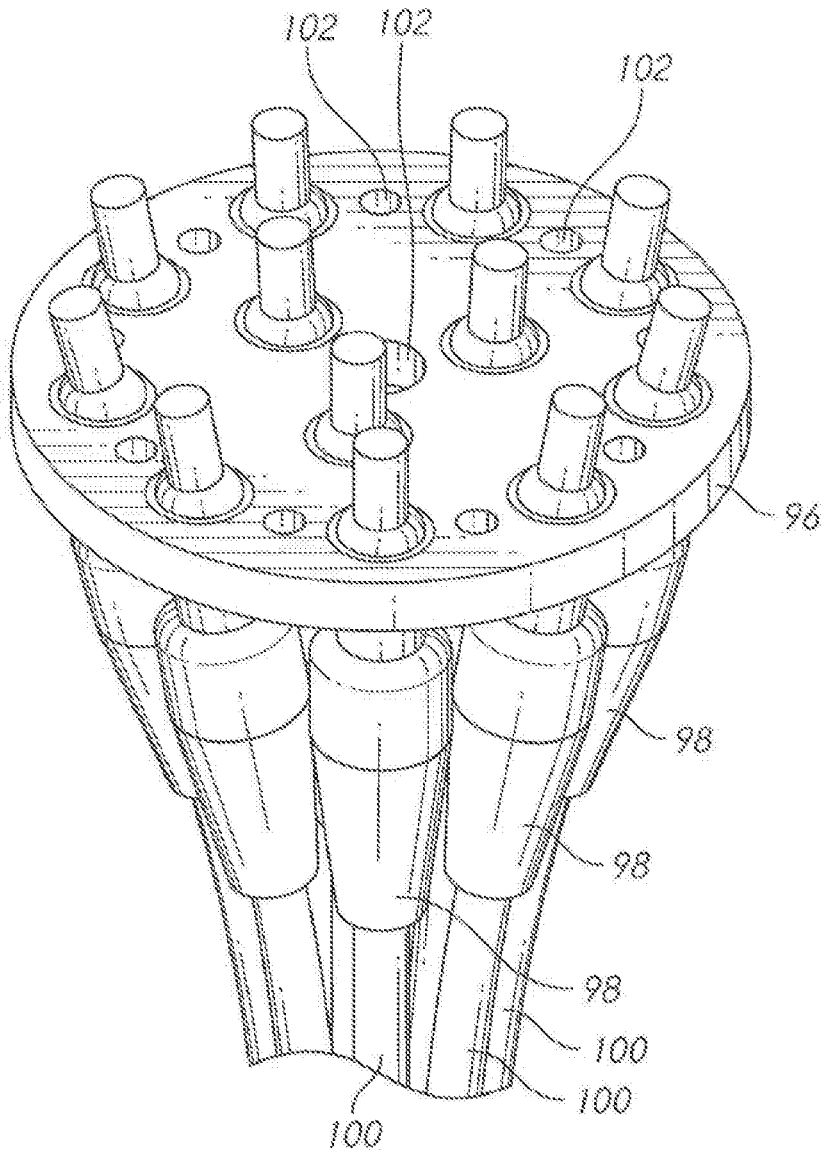
FIG. 18 (Prior Art)
FIG. 18 is a perspective view, showing components of a termination for a multi-stranded rope.
Figure 19:
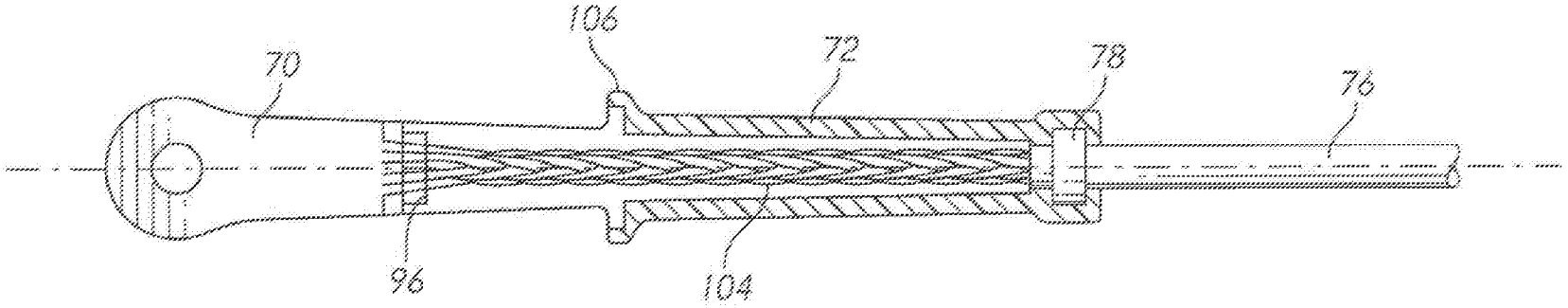
FIG. 19 is a sectional elevation view, showing components of a termination for a multi-stranded rope.

The cable itself is made of several individual strands that are braided, woven, or twisted together. A braided example is shown. Termination 70 typically includes a fairly complex assembly. FIG. 18 shows a perspective view of one of the internal components. An anchor 98 is attached to the end of each individual strand 100 in the cable (such as by potting). Each anchor is then attached to collector 96 using an attachment feature 102. FIG. 19 shows a sectional elevation view through termination 70 (in a simplified form). Collector 96 is mounted within the body of the termination. All the individual cable strands are connected to the collector. The collector is secured within a larger structure (in this case a loading eye that is used to connect to a transverse pin). Bend restrictor 72 attaches to the termination at flange 106. Jacket 76 extends in this example all the way to bend restrictor 72.

Figure 20:
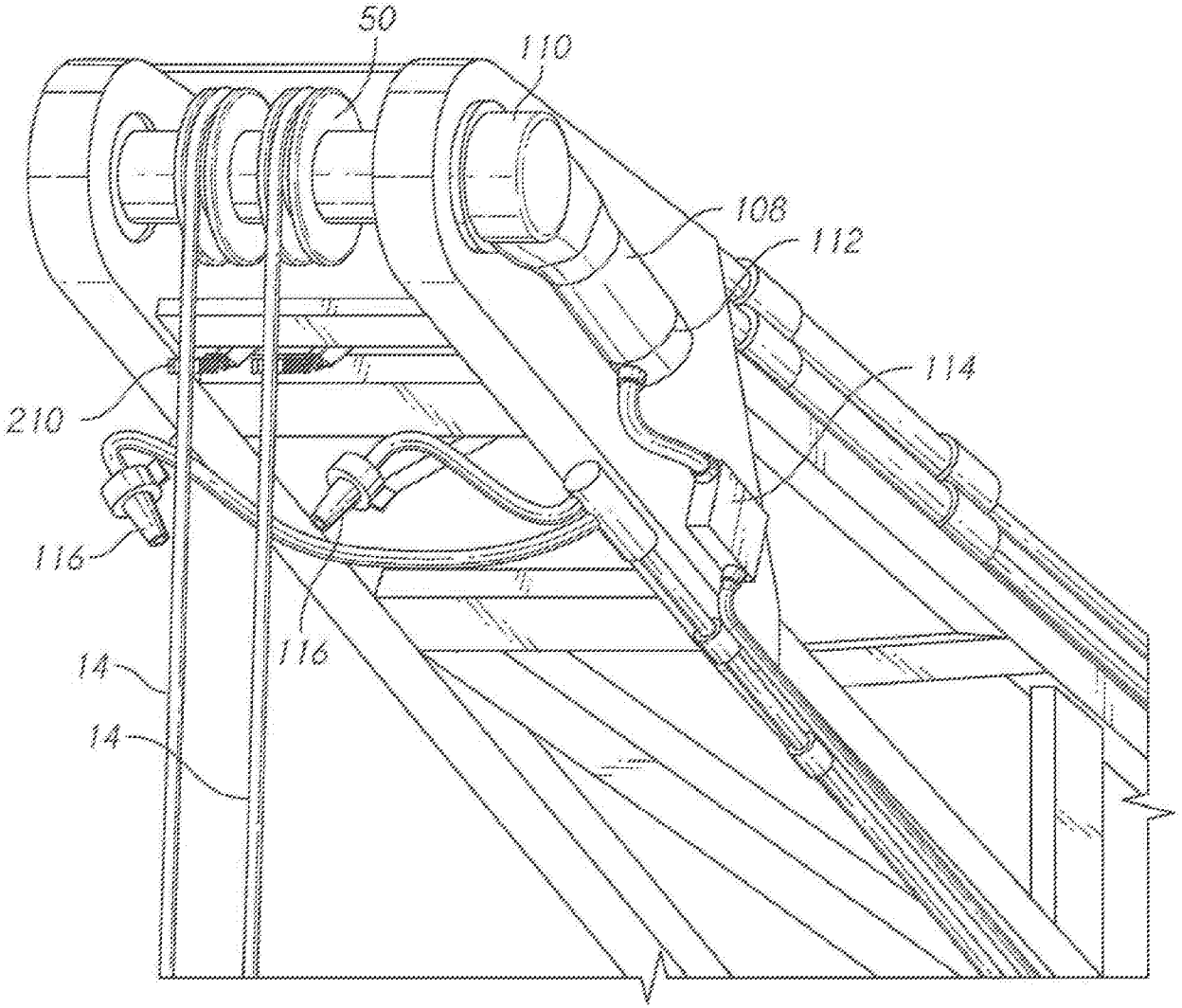
FIG. 20 is a perspective view, showing a driven point sheave on a dragline crane.

The use of advanced synthetics offer significant advantages for dragline cranes and similar machinery. There are disadvantages as well, however. Wire rope is inherently tough and can be passed over the various sheaves many times without significant damage. Synthetic rope—even when contained within a jacket—is not as tough. FIG. 20 illustrates an embodiment intended to address some of the concerns with using synthetic rope.

Lift ropes 14 in the view are made of synthetic filaments (or largely of synthetic filaments in the case of a hybrid rope). The lift ropes pass over point sheave 50. Point sheaves 50 are traditionally heavy steel structures possessing a great deal of inertia. As the lift ropes are lifted up and down by the hoist drum in the cab, they may slip of the point sheave. To address this concern the point sheave in the embodiment shown is positively driven.

Drive motor 108 drives the point sheave through reduction gear 110. Encoder 112 provides information regarding the position and rotational velocity of the point sheave. This information is fed to control unit 114, which controls the motion of drive motor 108. In one approach the motor is driven so that point sheave 50 matches the speed of the lift rope—as the lift rope is reeled in or paid off. The point sheave may also be selectively driven faster than the linear speed of the lift ropes, or slower.

A second concern with the use of synthetic ropes is the presence of heavy dust, small particulate debris, and even small stones between the lift ropes and the point sheave. These may be thrown or carried up from the region of the bucket. In the version shown a pair of spray nozzles 116 are directed toward the lift ropes. These spray high pressure water. They may be periodically activated (such as when the bucket is being lifted—or they may remain active at all times. The nozzles tend to blast dust and debris off the lift ropes before they pass over the point sheave. They also tend to cool the lift ropes.

Additional nozzles may be provided for the point sheave itself. These additional nozzles can provide cooling water for the point sheave. Temperature sensors on the sheave can be used to determine when cooling water is desirable.

In addition to the spray nozzles, the inventive embodiment can also include a mechanical cleaning element—such as brush assembly 210. Brush assembly 210 surrounds the two lift ropes. As the two lift ropes are pulled upward the brush assembly tends to remove dust and debris from the cables.

The use of synthetic ropes allows the substitution of softer and lighter materials for the various sheaves on the crane—including the point sheave. As an example, aluminum may be substituted for steel in the sheaves. The use of aluminum reduces weight and—also significantly—rotational inertia.

Figure 21:
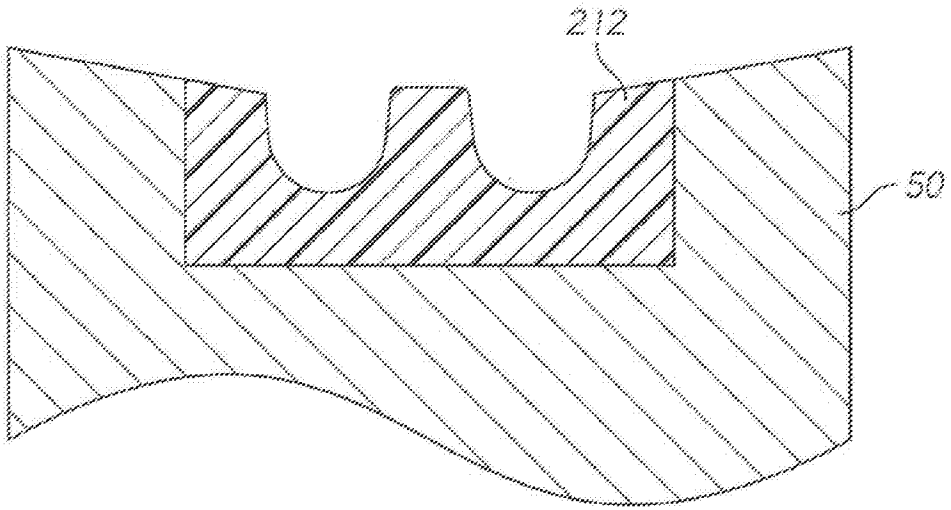
FIG. 21 is a sectional elevation view, showing a point sheave with a sacrificial insert.

It is also possible to place a softer insert into the point sheave at the point of contact with the lift ropes. FIG. 21 shows an embodiment of point sheave 50 including insert 212. The point sheave itself in this example is made of metal but the insert is made of a high-strength polymer such as DELRIN. In another embodiment the point sheave is made of alloyed high-strength aluminum while the insert is made of soft aluminum.

Figure 22:
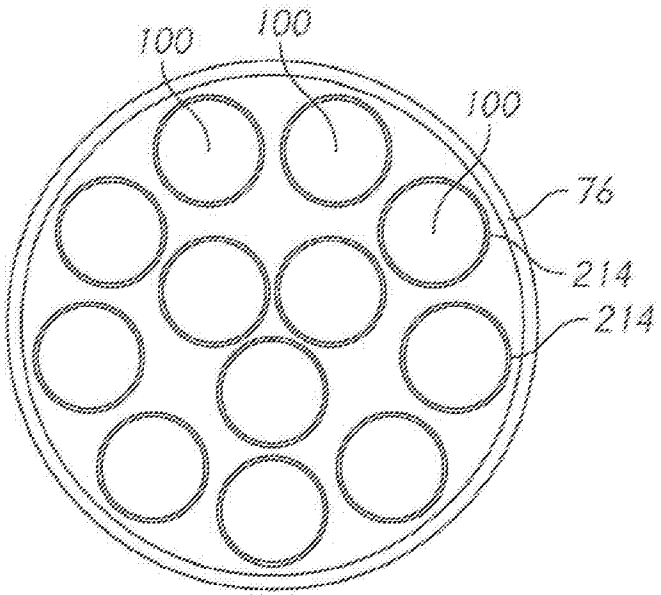
FIG. 22 is a sectional view, showing a multi-stranded rope with strand jackets and an overall jacket.

The use of a tough "armoring layer" over the outside of a synthetic rope will be desirable in many applications for heavy machinery. FIG. 22 shows a section view through a synthetic rope. This particular rope is a braided construction including 12 separate strands 100. Each individual strand is encased within a tough strand jacket 214. The cable as a whole is encased within jacket 76. Jacket 76 is preferably a very tough material, having significant thickness.

Figure 23:
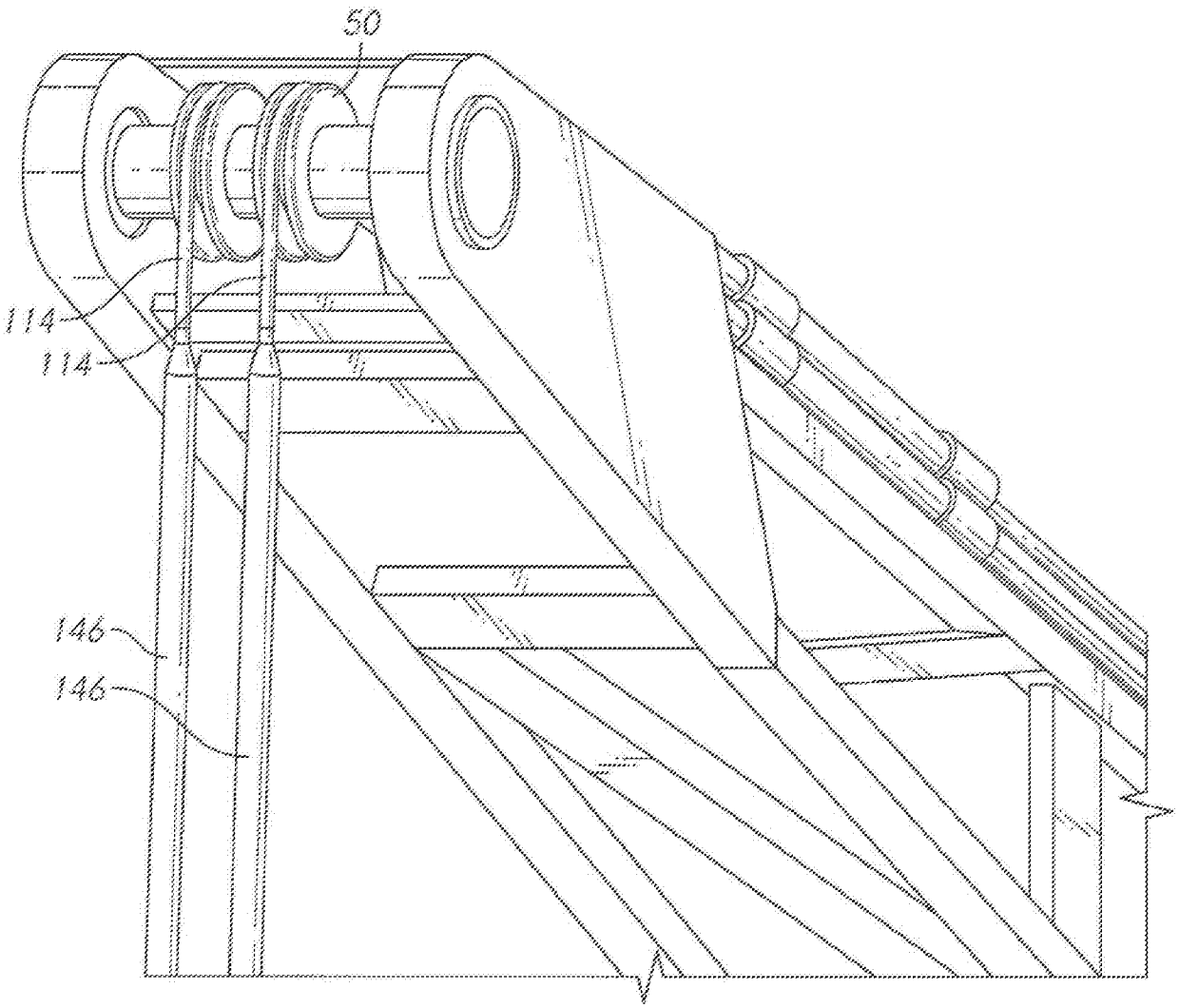
FIG. 23 is a perspective view, showing the use of cable armoring proximate a point sheave.

The material and the thickness can be varied for different regions of a cable. FIG. 23 shows an example. Lift rope 114 is enclosed within a jacket 76. However, in the region reaching down from point sheave 50 to the dragline bucket assembly, a much thicker jacket is used. This thicker jacket is denoted as cable armoring 146.

Cable armoring 146 is not able to easily pass around the point sheave. In the position shown in FIG. 23, lift ropes 114 are shown at the maximum upward travel of the dragline bucket assembly. The reader will note how cable armoring 146 stops just below point sheave 50. The uppermost extent of cable armoring 146 is set so that it will not need to contact the point sheave during the dragline crane's operation. The lowermost extent of the cable armoring goes all the way down to the bucket assembly—since this is the most hostile part of the environment.

Figure 24:
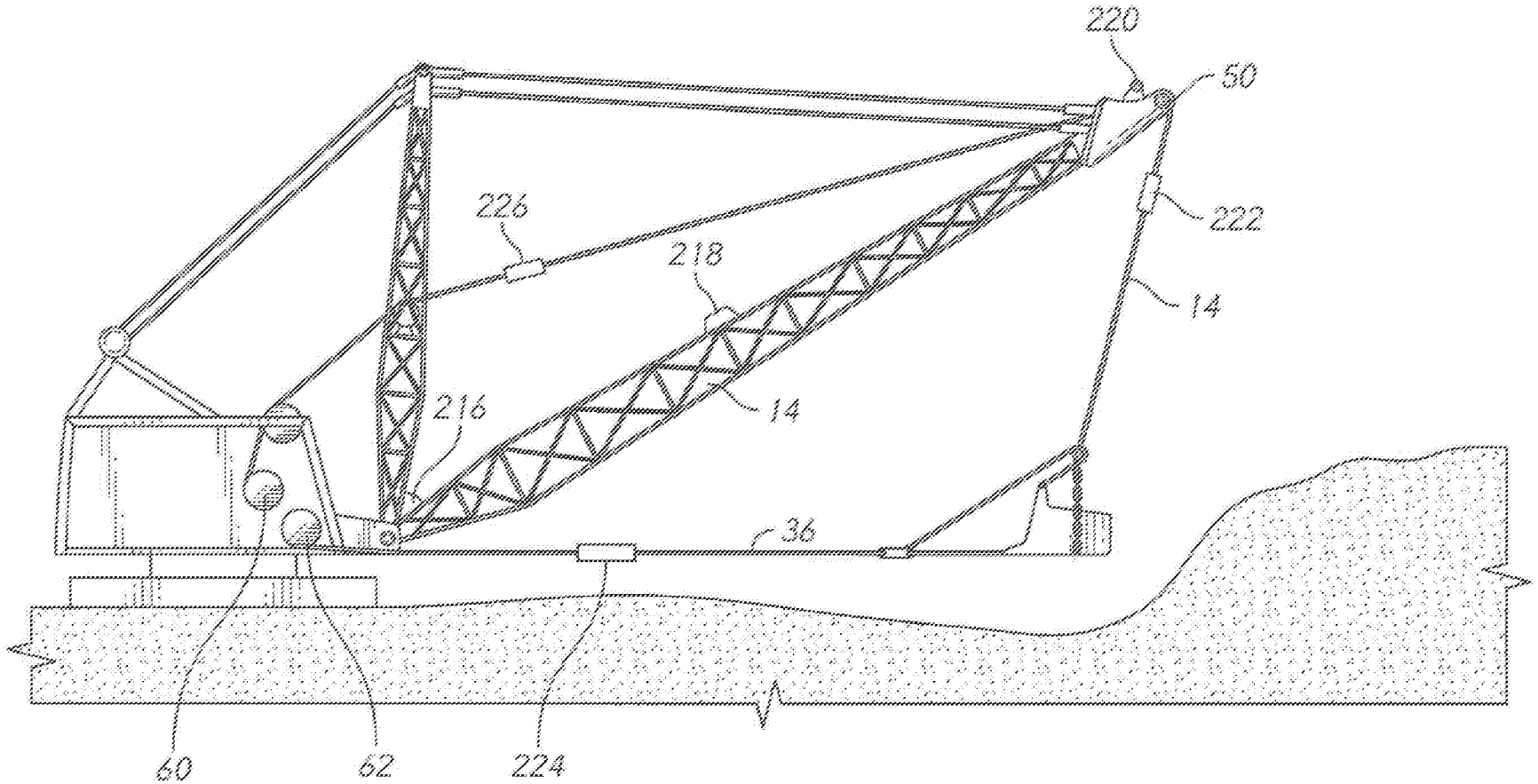
FIG. 24 is an elevation view showing a dragline crane incorporating instrument units and various rope junctions.

FIG. 24 shows some additional embodiments of the present inventive system. The reader will note that lift rope 14 includes wire rope junction 226. Wire rope works well on the drum itself. The portion of the lift rope on hoist drum 60 and extending out to wire rope junction 226 in this embodiment is conventional wire rope. The portion of the wire rope extending from wire rope junction all the way out to the bucket assembly is made from high-strength synthetic filaments (or mostly so), However, the portion of lift rope 14 below lift rope junction 222 includes additional cable armoring for protection. Thus, the single lift rope has three distinct sections: (1) conventional wire rope around the drum and up to wire rope junction 226; (2) high-strength synthetic filaments from wire rope junction 226 to lift rope junction 222; and (3) high-strength synthetic filaments encased in cable armoring from lift rope junction 222 down to the bucket assembly.

Likewise dragline rope 36 includes dragline junction 224. Conventional wire rope can be used around dragline drum 62 and out to dragline junction 224. Outward from the dragline junction rope made from high-strength synthetic filaments (or mostly so) is used.

FIG. 24 also illustrates the inclusion of various instrument units to measure and record the motion of different parts of the structure, and stresses on different parts of the structure. It is known in the industry to include strain gauges on various portions of the boom and mast structures. These are used to measure elastic deformations and thereby gain some knowledge about the movements and forces involved. This knowledge can be used to detect operator abuse, imminent component failure, and other useful things. Strain gauges are not very accurate, however, particular with the bouncing motions of the boom and mast.

Accurate inertial measurement units have now become relatively affordable. These units now incorporate MEMS instruments for linear acceleration measuring and ring-laser-gyros for attitude measuring. An internal processor then integrates the linear acceleration information and creates a full 6 degree-of-freedom "picture" of the location and orientation of the particular inertial measurement unit.

In the embodiment of FIG. 24, base instrument unit 216 includes an inertial measurement unit. It is located proximate the base of the boom. Tip instrument unit 220 contains the same instrumentation. It is mounted near point sheave 50. These two units continuously measure the position and orientation of the two ends of the boom. This information is then fed to a central processor that uses the relative position to monitor the actual motion of the boom.

As an example, if the dragline crane moves forward into an area of soft soil the entire machine will tip forward somewhat. If only the motion at the tip were available, one might conclude that the boom had experienced a substantial load. However, with the motion of the base and the tip available, a monitoring system will "know" that the tip motion is just a result of the entire machine tipping forward somewhat and not the result of a substantially increased load on the boom.

Additional instrument units may be added along the span of the boom. FIG. 24 shows the inclusion off mid-span instrument unit 218. This mid-span unit is helpful in detecting the bending of the boom in its primary bending mode (a "banana" shape). Even more mid-span instrument units can be added to detect higher-order bending modes and for other purposes.

It is useful to monitor the load in things such as bridge support ropes 68. Load measurement is typically inferred by measuring elongation. However, as high-strength synthetic filaments have a very high modulus of elasticity, it can be difficult to measure load via measuring elongation.

Figure 25:
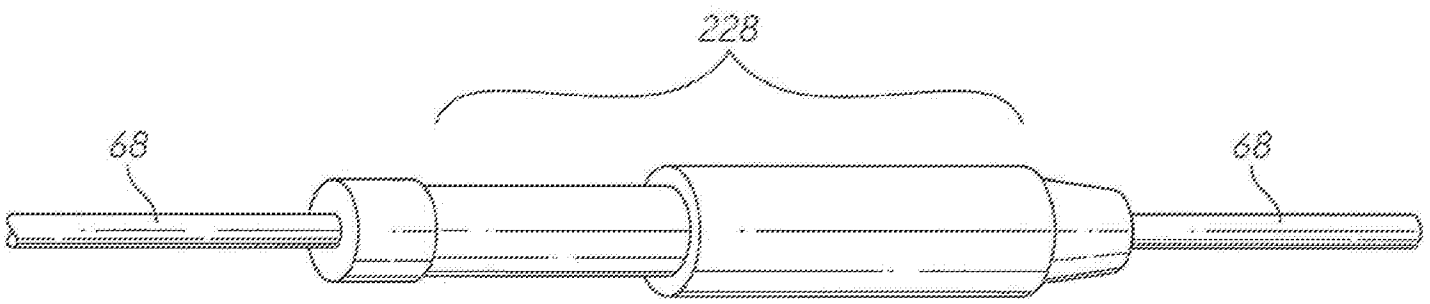
FIG. 25 is a perspective view, showing the addition of an elongation measurement device on a bridge support rope.

FIG. 25 shows an embodiment of an elongation measurement unit that can be placed in a synthetic rope such as a bridge support rope 68. Each end of telescoping sleeve 228 is connected to bridge support rope 68. The two portions of the telescoping sleeve are linked by an element where elongation is easily measured. As an example, they can be linked by a steel rod. A strain gauge or gauges are then place don ten steel rod and the elongation of the steel rod is used to infer the load on the bridge support rope.

Although the preceding description contains significant detail, it should not be construed as limiting the scope of the invention but rather as providing illustrations of the preferred embodiments of the invention. Thus, the language ultimately used in the claims shall define the invention rather than the specific embodiments provided.

Having described my invention, I claim:

1. A dragline crane for scooping material from a surface, comprising:

a. a cab;

b. a boom extending from said cab to a point sheave;

c. a bucket assembly;

d. a lift rope extending from said bucket assembly over said point sheave and to said cab, said lift rope being wrapped around a hoist drum;

e. said lift rope configured to cycle between a low position in which said bucket assembly is lying on said surface and a high position in which said bucket assembly is lifted free of said surface;

f. said lift rope including a wire rope portion wrapped around said hoist drum and extending out to a wire rope junction, and a synthetic portion extending from said wire rope junction over said point sheave to said bucket assembly;

g. wherein said wire rope junction lies between said hoist drum and said point sheave when said bucket assembly is in said low position and said high position; and h. cable armoring on said lift rope, extending from proximate said bucket assembly up to a level just below said point sheave when said bucket assembly is in said high position.

2. A dragline crane as recited in claim 1, further comprising:

a. a dragline rope configured to pull said bucket assembly toward said cab;

b. a portion of said dragline rope being wrapped around a dragline drum;

c. said dragline rope including a wire rope portion wrapped around said dragline drum and a synthetic portion attached to said bucket assembly; and d. said wire rope portion of said dragline rope being joined to said synthetic portion of said dragline rope by a dragline junction.

3. The dragline crane as recited in claim 1, wherein said cable armoring comprises fiber-reinforced rubber.

4. The dragline crane as recited in claim 1, further comprising a collar sealing an upper end of said cable armoring.

5. The dragline crane as recited in claim 1, wherein said point sheave is powered.

6. The dragline crane as recited in claim 1, further comprising a spray nozzle configured to clean said lift rope before it passes over said point sheave.

7. The dragline crane as recited in claim 1, further comprising a brush assembly configured to clean said lift rope before it passes over said point sheave.

8. A dragline crane for scooping material from a surface, comprising:

a. a cab;

b. a boom extending from said cab to a point sheave;

c. a bucket assembly;

d. a lift rope extending from said bucket assembly over said point sheave and to said cab, said lift rope being wrapped around a hoist drum;

e. said lift rope configured to cycle between a low position for said bucket assembly and a high position for said bucket assembly;

f. said lift rope including a wire rope portion wrapped around said hoist drum and a synthetic portion attached to said bucket assembly;

g. said wire rope portion being joined to said synthetic portion by a wire rope junction; and h. wherein said wire rope junction is positioned to remain between said hoist drum and said point sheave when said bucket assembly is in said low position and said high position.

9. A dragline crane as recited in claim 8, further comprising:

a. a dragline rope configured to pull said bucket assembly toward said cab;

b. a portion of said dragline rope being wrapped around a dragline drum;

c. said dragline rope including a wire rope portion wrapped around said dragline drum and a synthetic portion attached to said bucket assembly; and d. said wire rope portion of said dragline rope being joined to said synthetic portion of said dragline rope by a dragline junction.

10. The dragline crane as recited in claim 8, further comprising cable armoring on said lift rope tope, extending from proximate said bucket assembly up to a level just below said point sheave when said bucket assembly is in said high position.

11. The dragline crane as recited in claim 10, further comprising a collar sealing an upper end of said cable armoring.

12. The dragline crane as recited in claim 8, wherein said point sheave is powered.

13. The dragline crane as recited in claim 8, further comprising a spray nozzle configured to clean said lift rope before it passes over said point sheave.

14. The dragline crane as recited in claim 8, further comprising a brush assembly configured to clean said lift rope before it passes over said point sheave.

* * * * *